US008092308B2

(12) United States Patent
Hartmann et al.

(10) Patent No.: US 8,092,308 B2
(45) Date of Patent: Jan. 10, 2012

(54) NETWORKED GAMING SYSTEM

(75) Inventors: Andreas Hartmann, Gilbraltar (GI); Michael O'Malley, Upland, CA (US)

(73) Assignee: PartyGaming IA Limited, Hamilton (BM)

( * ) Notice: Subject to any disclaimer, the term of this patent is extended or adjusted under 35 U.S.C. 154(b) by 416 days.

(21) Appl. No.: 12/373,696

(22) PCT Filed: Jul. 13, 2006

(86) PCT No.: PCT/US2006/027459

§ 371 (c)(1),
(2), (4) Date: Apr. 27, 2009

(87) PCT Pub. No.: WO2008/008072

PCT Pub. Date: Jan. 17, 2008

(65) Prior Publication Data

US 2009/0253516 A1 Oct. 8, 2009

(51) Int. Cl.
*A63F 9/24* (2006.01)

(52) U.S. Cl. ..... 463/42

(58) Field of Classification Search ..... 463/42
See application file for complete search history.

(56) References Cited

U.S. PATENT DOCUMENTS

| | | | | |
|---|---|---|---|---|
| 6,502,076 | B1 | 12/2002 | Smith | |
| 6,529,903 | B2 | 3/2003 | Smith et al. | |
| 7,031,961 | B2 | 4/2006 | Pitkow et al. | |
| 2005/0159204 | A1 * | 7/2005 | Moshal | 463/17 |

FOREIGN PATENT DOCUMENTS

| | | |
|---|---|---|
| WO | WO 00/24484 | 5/2000 |
| WO | WO 02/059810 | 8/2002 |
| WO | WO 03/069497 | 8/2003 |
| WO | WO 2006/032986 | 3/2006 |

OTHER PUBLICATIONS

International Searching Authority (ISA), Notification of Transmittal of the International Search Report and the Written Opinion of the ISA, or the Declaration, PCT/US2006/027459, Date of Mailing Dec. 20, 2006, 11 pages.

Fortune Lounge, Fortune Lounge Personal Messenger, available at http://www.fortunelounge.com/fldtc/FLPM_Download_new.asp?BTag.' (last visited Jun. 13, 2006), screenshots 1-3.

(Continued)

*Primary Examiner* — N Drew Richards
*Assistant Examiner* — Yu-Hsi D Sun
(74) *Attorney, Agent, or Firm* — Beem Patent Law Firm

(57) ABSTRACT

A networked gaining system wherein a game client application connects a player to at least one game server having at least one game table. The game server provides game operations and displays for transmission to the game client application and a display including at least one screen display designating a lobby from which a player can request to be seated at one or more of a plurality of virtual game positions in one of a plurality of multi-player games. The at least one lobby screen display is accessible without the user having to login to the game client application. Further, a player may configure the networked gaming system so that when the user logs-in, the player is immediately taken to a game and "bought-in", if necessary. An embodiment of the present invention is disclosed as an overlay messaging program incorporating the above features.

20 Claims, 14 Drawing Sheets

OTHER PUBLICATIONS

Belle Rock Entertainment, Online Casino Players Buddy Up to Belle Rock Entertainment, Jul. 19, 2005, pp. 1-2, Gibraltar, available at http://www.bellerockentertainment.com/about/art7.asp?VT=11640744&s=aff92327 (last visited Jun. 13, 2006).

Belle Rock Entertainment, Belle Rock Buddy, available at http://www.riverbelle.co.uk/buddy-splash.asp?VT=102&EventId=26710 (last visited Jun. 13, 2006), screenshots 1-8.

Bodognation.com, Relax with Bodog QuickSeat, Jan. 27, 2006, pp. 1-2, *available at* http://www.bodognation.com/poker-news/get-in-the-game-faster-with-bodog-quickseat.html (last visited Jun. 13, 2006).

Bodog.com, Quick Tour of Bodog Online Poker, pp. 1-2, *available at* http://www.bodog.com/poker/quick-tour.jsp (last visited Jun. 13, 2006).

Bodog.com, The Bodog QuickSeat, *available at* http://www.bodog.com/poker/download-poker.jsp (last visited Jun. 13, 2006), screenshot 1.

* cited by examiner

NETWORKED GAMING SYSTEM

BACKGROUND OF THE INVENTION

1. Field of the Invention

The present invention is directed to one or more networked gaming systems, each having a plurality of games available to the user.

2. Description of Related Art

Several categories of networked gaming systems are well known in the prior art. A networked gaming system may be a web-based java application, like Yahoo! Games. Further, a networked gaming system may be in the form of a downloadable software application that has a unique graphical user interface and may connect to the Internet via the back end of the software, like, for example, the PartyPoker.com client application. Even further, a networked gaming system may be in the form of a networked video game console wherein the several players in a game are connected to a network through their video came console (i.e. Xbox). Other categories of networked gaming systems are apparent to those persons having ordinary skill in the art.

A user connected to a networked gaming system may choose to play one or more of the available games. In some networked gaming-systems there may be over one hundred different available games, making the selection of a specific game very cumbersome. The user may have already decided what game to play before connecting to the networked gaming system. If so, the user will have to search through the plurality of available games to locate the particular game the user would like to play. This may become burdensome when there are a large number of games offered by the networked gaming system.

When the user finally locates the game the user would like to play, there may be multiple variations of the specific game available for play. For example, for the game of poker there may be multiple games (Limit Hold'em, No-Limit Hold'em, Pot-Limit Hold'em, Omaha, 7-Card Stud, Razz), multiple game styles (cash game, tournament, sit-and-go, freeroll), and multiple game stakes ("$0.05/$0.10 Limit" through "No-Limit"). For the game of poker, there may be thousands of available variations available to the user of the networked gaming system.

Even once the user has located the game that the user would like to play, and has further located the desired variation of that specific game, the user may not be able to play because all available player positions or tables are full for that specific variation of the game. This is a very common concern for users who like to play popular games because any available position/seat is filled almost instantly after it becomes vacant. This is a major concern for networked gaming system operators because users may become frustrated and decide not to play on that particular networked gaming system in the future. Having a waiting list is known to those having ordinary skill in the art, but a waiting list is not effective because of its inherent deterrent effects. Having to wait for a game may cause a decrease in revenue for the networked gaming system or a reduction in the amount of money that the networked gaming system may earn through advertising.

Attempts have been made to alleviate some of the problems users face when trying to connect to a specific game of a networked gaming system. One downloadable poker client has a feature called "QuickSeat" that lets players bypass the lobby and choose which limit, game type, and stakes they would like to play. But, the QuickSeat feature fails to adequately solve the problems associated with networked gaming systems having a plurality of games available to the user. First, the QuickSeat feature only allows faster seating to Hold'em poker tables, and does not allow for faster seating to Omaha, 7-Card Stud, Razz, or other games. Second, the QuickSeat feature has only three fields by which the user may narrow the game selection process. Third, the QuickSeat feature does not automatically "buy-in" to the table (i.e. take money out of the user's account and sit at the table with that money). Once a table has been found that meets the three search criteria, the user still has to select how much money he would like to take to that table. Fourth, the QuickSeat feature cannot save a user's preferences and automatically seat a player at a table that meets various user-defined criteria. A player using the QuickSeat feature must re-enter his search criteria each time the user logs in to the networked gaming system.

BRIEF SUMMARY OF THE INVENTION

A networked gaming system wherein a game client application connects a player to at least one game server having at least one game table. The game server provides game operations and displays for transmission to the game client application and a display including at least one screen display designating a lobby from which a player can request to be seated at one or more of a plurality of virtual game positions in one of a plurality of multi-player or single-player games. The present invention may be incorporated into an overlay application, with the game server providing game operations and displays for transmission to said overlay application. The displays include at least one lobby screen display accessible by the overlay application without a player having to login to the overlay application. Also, a player may configure the networked gaming system so that when the user logs-in, the player is immediately taken to a game and "bought-in," if necessary. An embodiment of the present invention is disclosed as an overlay messaging program incorporating the above features.

In one embodiment, the invention is incorporated into the networked gaming system application, such that when a user logs in to networked gaming system, the user is immediately taken to his preferred game.

In another embodiment, the present invention is incorporated into a separate overlay application on the user's PC, independent of the networked gaming system application, but closely connected with the networked gaming system's backend. Thus, the overlay application may be distinct from the game client application. The overlay application may be capable of sending information to the game server or receiving information from the game server.

In yet another embodiment, the present invention is incorporated into a messaging program on the user's PC, independent of the networked gaming system application, but closely connected with the networked gaming system's backend.

These and other features and advantages are evident from the following description of the present invention, with reference to the accompanying drawings.

DETAILED DESCRIPTION

The description herein describes an embodiment of the present invention, namely where the invention is incorporated into an overlay application, more specifically a messaging application, that is closely connected to the networked gaming system's backend. In an alternate embodiment of the present invention, the invention is incorporated into the networked gaming system directly. Persons having ordinary skill in the art recognize that the invention is not limited to those embodiments discussed herein.

1. Open/Close

There are several ways for a messaging application to become active. In one embodiment, at Windows startup the messaging application starts in minimized mode, loads into the system tray and tries to connect. This gives the messaging application less exposure, but is more user-friendly because the user does not always have to login manually. Also, the messaging application can be opened manually. The user may click on any shortcut icon or directly on the .exe file, and the messaging application loads into the system tray and maximizes. Wherein when any two of said game client applications are designated as client X and client Y, when either client X or client Y is installed a corresponding lobby X or lobby Y may open from the overlay application, when both clients X and Y are installed, a lobby which was last open when the application was running the last time may be opened from the overlay application, and when no client is installed, a predetermined lobby may be opened from the overlay application. When no client is installed the predetermined lobby may be a news lobby or events lobby. Furthermore, wherein at least one game client application is installed on a computer, each game client application lobby, and any games therein, may be opened from each of the at least one game client applications.

2. Navigation—While Minimized

Figure 2:
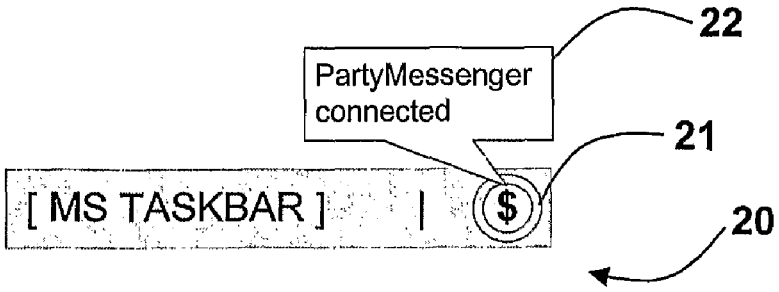
FIGS. 2-4 are screen shots of Windows system trays with application icons and callouts.

Referring to FIG. 2, while a messenger icon 21 is present in the Windows system tray 20, right-clicking on the icon 21 will open a navigation tree. The navigation tree may include the following choices: QuickLinks, Launch, Favorites, Settings, Help, System Info, Version, Connect/Disconnect, Snooze, Log in/out, or Minimize/Maximize.

The "QuickLinks" choice may be a list of links, each of which opens in a new browser window. All areas should have different browser targets. The QuickLinks menu may contain links to areas such as: My Account, My Bonus Offers, My Points, Cashier, Poker, Casino, Send This Program to a Friend, Legal Info, About Us, or others that would be obvious to those having ordinary skill in the art. The "Poker" link may contain a subclass of links, such as How To Play, Poker School, Poker Glossary, News & Events, or Tournament Info & Schedule. The "Casino" link may contain a subclass of links, such as Games and Rules, News & Events, or others.

Figure 1:
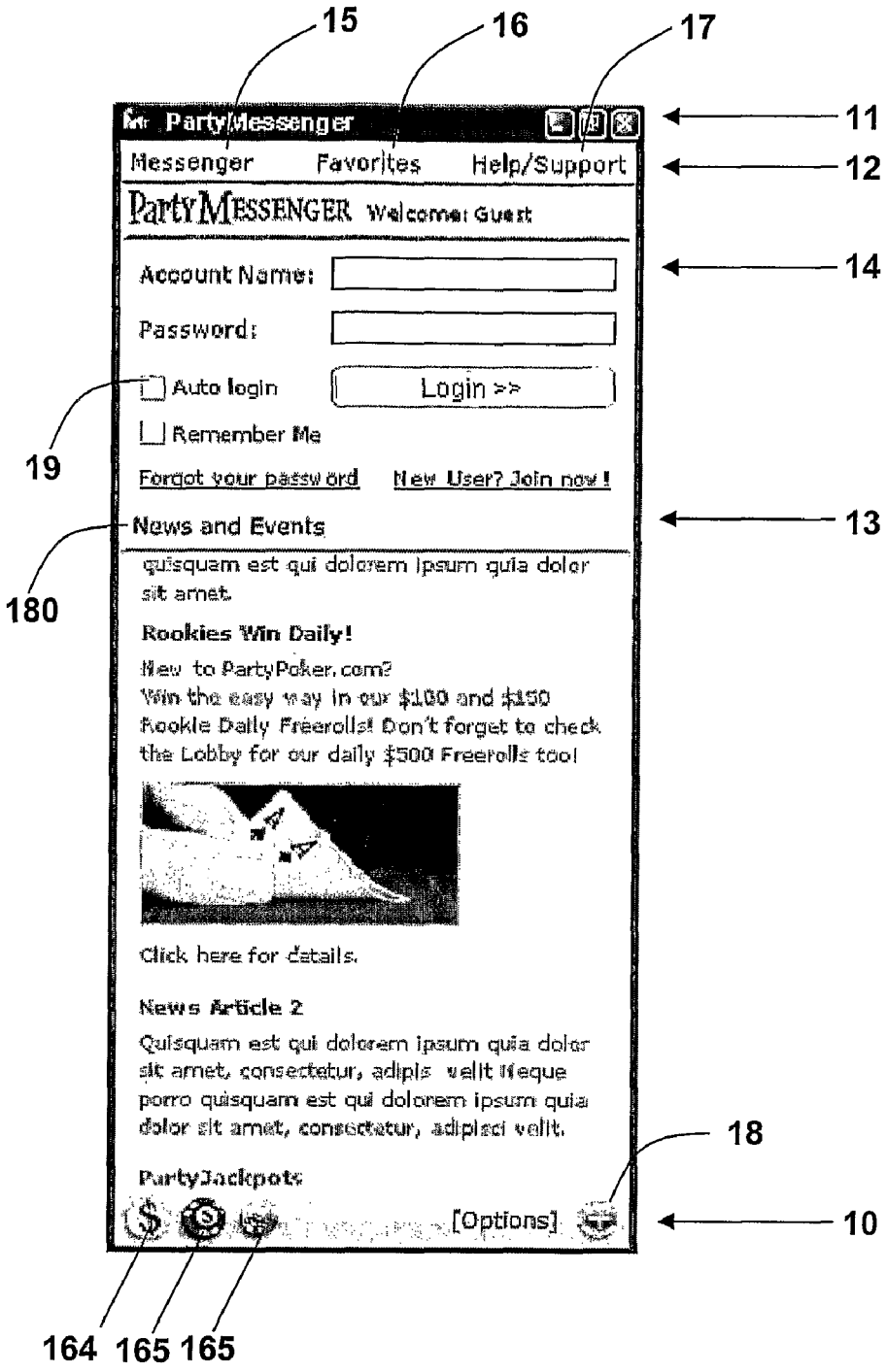
FIG. 1 is a screen shot of an embodiment of the present invention, more specifically of a messaging application that incorporates the present invention.

The behavior of the "Launch" feature is in sync with a QuickLaunch bar 10 of the messaging application, as seen in FIG. 1. The Launch sub-menu is a listing of all brand-specific client applications that the user has already installed, plus a "Get More" selection 18, which opens another menu listing all brand-specific client applications available and not installed on the user's computer. All installed client selections will launch the according client. In case the client is already open, it will be the active window, i.e. jumping into the front of the monitor. Clicking on a not installed client will start the download/installation procedure for that specific client application.

The "Favorites" feature allows users to set up a favorite games list and have quick access to these games. This feature will be discussed in depth later.

The "Settings" feature opens up a separate window, which lets the user manage all of his settings. An example of such a setting is "Network Status." A network status window, which may be integrated into the networked gaming system application, may open up and follow the same behavior as the network status window on the networked gaming system application.

The "Help" feature allows the user to get help or support for the client applications or for the messenger. Also it may provide frequently asked questions (FAQs) that may help the user with problems.

The "System Info" feature may opens same information page as on the networked gaming system application connected to the messaging application.

The "Version" feature may open the same info as on the networked gaming system application connected to the messaging application.

Figure 3:
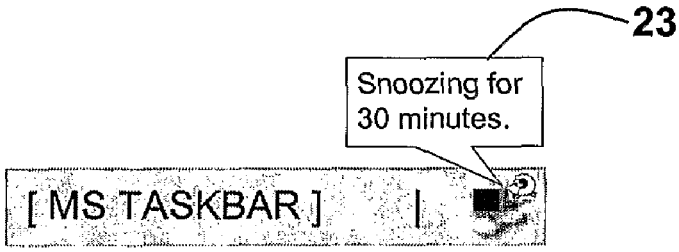
Figure 4:
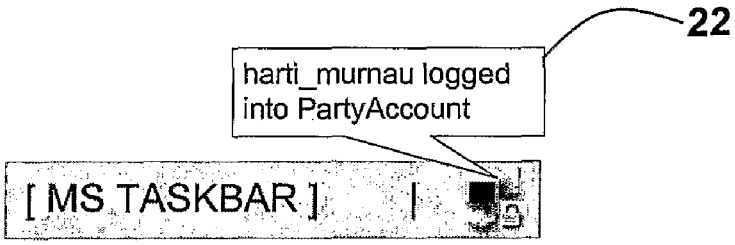

The "Connect/Disconnect" feature may facilitate re-connecting if the connection is lost. If the user is disconnected, a menu item "Connect" will be shown. By clicking on it, the messaging application will try to connect to the Internet and the networked gaming system application. If the user is connected, no selection will be shown. Referring to FIGS. 2-4, when the messaging application connects, a small callout 22 may popup from the messaging application icon 21 indicating the connection. This callout 22 may appear after the user manually connected to the web or the application established connection automatically. When the messaging application disconnects, a callout 22 may popup saying notifying the user of the disconnection. This callout 22 may appear if the messaging application lost connection to the web. In case the user was also logged in, the session will also be terminated, and only the "Disconnected" callout 22 will appear, not the "Logged out" callout 22.

The "Snooze" feature may indicate if a user is idle. Referring to FIG. 3, when the user snoozes the messaging application for "X" minutes or, hours, a snooze callout 23 may popup saying "Snoozing for X minutes." "X" will be the value selected by the user. The snooze callout 23 may have the capability to countdown the hours and minutes. This would require including dynamic content into the snooze callout 23 and incorporating a countdown which incorporates minutes and hours. Hitting the snooze option more then once will not add to the snoozing time. For example, if the user selects one hour twice, the messaging application will still only snooze for one hour. In case the user hits snooze for one hour and after ten minutes (fifty min left) hits snooze again, the period of snoozing goes up to one hour again.

The "Log in/out" feature facilitates logging in or out of the system. Referring to FIG. 4, when the messaging application logs in, a callout 22 may popup indicating logging in. When the messaging application logs out, a callout 22 may popup indicating logging out. This callout 22 will only appear if the user manually logs out, or the connection to just the account backend is lost while other internet connections still work.

The "Minimize/maximize" feature allows a user to toggle between minimized mode and maximized mode.

3. Navigation—While Maximized

The messaging application can be maximized (i.e. the window can be opened) by double-clicking on the messaging application icon 21 in the system tray 20, or right-clicking on the messaging application icon 21, when in minimized mode and selecting "Maximize." When in maximized mode, double-clicking does not have any effect. If the messaging application is not the active window, it will jump to the front of the desktop at double-click.

The location of the maximized messaging application window may be a default location where the messaging application will be opened just above the system tray 20, right-aligned to the bottom right of the user's primary monitor. Anticipating the fact that the messaging application could place itself above another messenger application already in use, the messaging application should be able to look out for other windows in the area (Yahoo!, MSN, AOL, or Google messengers) and place itself directly left of the already existing messenger. The user may drag the messaging application to any location on the visible screen. When the messaging application is minimized and later maximized, the gaming messaging application will open at the same location. That location will be remembered by the messaging application so that in future if when user starts up the application it can be opened at that same location again. If the monitor resolution is decreased (by user or other applications like the user of a projector), the messaging application should support being replaced by Windows to suit the smaller resolution as all Windows applications do. This could involve resizing the window of the messaging application. If the monitor resolution increases, the messaging application may stay at the same absolute coordinates as is and not resize.

Horizontal/vertical resizing should be possible. Minimizing the window will only be possible down to a minimum width and height. If the messaging application is horizontally increased, the HTML pages in the application dynamically extend as well. They may be built for a certain minimum width of the application, however they also need to support a smooth user interface when the width of the application is increased.

Furthermore, where one of the game client applications and associated game client application lobbies is designated as a poker client and lobby, the poker lobby of the overlay (messaging) application may have substantially the same characteristics as the poker lobby of the client application with a different appearance. If the overlay application is maximized and the poker lobby is extended, the poker lobby of the overlay application will refresh independently of a player being logged in or not, snoozed or active, with respect to the game client application.

Referring to FIG. 1, the software interface of the messaging application may include a title bar 11, several drop-down menus 12, a footer or QuickLaunch bar 10, one or more sliders 13, a log-in section 14, and other sections that would be obvious to persons having ordinary skill in the art.

A. Title Bar

The title bar 11 may be a standard Windows title bar containing a logo for the application, the application name, a minimize button, and a close button.

B. Drop-Down Menus

One or more drop-down menus 12 may be available. The user interface may follow the same standards as normal Windows programs. In one embodiment, there may be three drop-down menu in the drop-down menu bar: Messenger 15, Favorites 16, and Help/Support 17.

Drop-Down Menu: Messenger

Under the drop-down menu "Messenger" 15 may be the following sub-menus: My Account, My Balance and Points, Cashier, Launch, Settings, Network Status, Connect/Disconnect, Snooze On/Off, Log In/Out, Minimize/Maximize, or other sub-menus that would be obvious to those having ordinary skill in the art.

The "My Account" sub-menu may open a new browser to a login page to view or edit account settings.

The "My Balance and Points" sub-menu may open a new browser window to an account balance page.

The "Cashier" sub-menu may open a new browser window to the account cashier page.

The "Launch" sub-menu behavior is in sync with the QuickLaunch bar 10 (or Footer section) of the messaging application. This sub-menu is a listing of all brand-specific client applications that the user has installed already and a "Get More" selection 18, which opens another menu, listing all brand-specific client applications available and not installed on the user's computer. All installed client selections will launch the according client. In case the client is already open, it will be the active window, i.e. jumping into the front of the monitor. Clicking on a not installed client will be starting the download/installation procedure for that specific client application.

The "Settings" sub-menu may open up a separate window that lets the user manage all his Settings. This single "Settings" sub-menu may manage all messaging application settings. It may include the following areas. On/off sections may be represented by checkboxes.

1. Startup and Login
1.1. Run when windows starts (on/off)
1.2. Automatic login at start (on/off)
1.3. Keep messenger on top of other apps (on/off)
2. Sounds
2.1. Turn all Sounds (on/off)
2.2. Turn Alert sound (on/off)
2.3. Turn Info sound (on/off)
2.4. Turn Error sound (on/off)
3. Alerts
3.1. Turn all Alerts (on/off)
3.1.1. All following items are graphically subordinated to this one.
3.2. News & Events (on/off)
3.3. Bonus offers/promotions for you (on/off)
3.4. Reminders (cannot be turn off, as only coming when requested by you)
3.5. LATER—Important messages regarding your account (always on): transactional messages always being sent
3.6. Be quiet for (same as Snooze feature in right-mouse click menu of tray icon)
3.6.1. 30 min
3.6.2. 1 hour
3.6.3. 2 hours
3.6.4. 4 hours
3.6.5. Permanent
4. Sections: may include
4.1. Poker Lobby
4.2. Casino Lobby
4.3. Backgammon Lobby
4.4. News & Events
4.5. My Account (cannot be turned off)
5. Reminder
5.1. First reminder: [60] minutes before tournament start
5.2. Second reminder: [30] minutes before tournament start
5.3. Third reminder: [15] minutes before tournament start
5.4. Keep third reminder in front of monitor (on/off)
5.4.1. By default this feature is on.
5.4.2. This feature requires the desktop alert being active until user clicks it away or goes to the tournament lobby.
6. Get latest Update: manually requested update starting visible updating process of new window with updating status bar and displaying steps of updates The "Network Status" sub-menu may be integrated into all brand-specific client applications. It follows the same behavior in the messaging application as in other brand-specific client applications.

The "Connect/Disconnect" sub-menu may have two states: "Connect" and "Disconnect." Selecting this sub-menu toggles between the "Connect" state and the "Disconnect" state. The current state may be represented with a checkmark in front of the sub-menu listing.

The "Snooze On/Off" sub-menu may have two states: "Snooze On" and "Snooze Off." Selecting this sub-menu toggles between the "Snooze On" state and the "Snooze Off" state. The current state may be represented with a checkmark in front of the sub-menu listing.

The "Log In/Out" sub-menu may have two states: "Log In" and "Log Off." Selecting this sub-menu toggles between the "Log In" state and the "Log Off" state. The current state may be represented with a checkmark in front of the sub-menu listing.

The "Minimize/Maximize" sub-menu has only state one state: "Minimize." Choosing this sub-menu will minimize the messaging application to the system tray.

Drop-Down Menu: Help/Support

The following is a list of possible sub-menus (and their actions) under the "Help/Support" drop-down menu 17. Doubly-indented menus are sub-level menus or flyouts.

1.1. "Send PartyMessenger to a friend" (opens email with text already added in)
1.2. "Help" (link to help page)
1.3. "Messenger FAQs"
1.4. "Legal Info & Security"
1.4.1. "Security"
1.4.2. "Your Privacy"
1.4.3. "Licensed & Regulated"
1.5. "About Us"
1.5.1. "Legal Information"
1.5.2. "Privacy"
1.5.3. "Responsible Gaming"
1.6. "System info" (opens same info as on the current client)
1.7. "Version" (opens same info as on the current client)

Drop-Down Menu: Favorites

A standard preferences, or "Favorites," 16 drop-down menu will be extended in data depth and functionality. Drop-down Favorites 16 may be vertical-independent, i.e. a user can have multiple favorites from various brand-specific client applications. Drop-down Favorites 16 may be included on an account-level, meaning that a user may set personal favorites. For advanced systems, the networked gaming system along with the messaging application may suggest Drop-down Favorites 16 to the user based on player game history.

The Drop-down Favorites 16 feature will cover three types of favorites: category favorites, direct favorites, and AutoSeat favorites. Each of the three types requires different handling in functionality and representation/messaging.

Category favorites are those of the type where a further selection by the user is still necessary before being able to access a game. When selecting a category, the proper brand-specific client application lobby may open up in the messaging program and the according sub-category opened. For example, if the user selects the category favorite "Slots," then the Casino lobby opens (if not already open) and the category slots expands.

Direct favorites are those of the type where a specific game can be directly accessed (not simply a category of games) and no additional refinement or action has to be done by the user. When clicking on a direct favorite, the user will directly be sent to the according game. The buy-in window opens and the user can buy in and sit down. All standard logic when accessing a table will be applied (e.g. if insufficient funds, then user will be prompted to go to cashier). For example if the user selects the direct favorite "Poker Cash Games: Cash>Pot-Limit Omaha>$0.10/0.25 PL," then the user will be automatically taken to a poker cash game, pot-limit Omaha where the "blinds" are $0.10 and $0.25. The user chooses the amount of his "buy-in" and sits down and may begin playing.

The overlay application may include a selectable automated seating option (or AutoSeat) for automatically seating a player at one or more of a plurality of virtual game positions, wherein a player is directly seated when the player logs-in to the networked gaming system. A networked gaming system may include an automated seating option (or "AutoSeat" feature") of said mobile game client application capable of receiving and storing personal preference information, including but not limited to a game category, a specific game type, stakes, and an amount of money to be taken from a player's account when seating a player, and for seating a player at a table in accordance with said stored personal preference information. AutoSeat favorites are those of the type where the user has selected the AutoSeat option and provided more information and is then automatically seated and "bought-in" when the user chooses this option. For example, if a user has the AutoSeat option selected on a No-Limit Hold'em table, having blinds of $1/$2, and a user buy-in of $200, then once the user signs on he will automatically be taken to a No-Limit Hold'em table, having blinds of $1/$2 and the user will be bought-in for $200 automatically. The goal of the AutoSeat functionality is to get users seated more quickly on a table.

The automated seating option of the game client application may be further selectable by the networked gaming system, whereby personal gaming history, including but not limited to a game category, a specific game type, stakes, or an amount of money that a player commonly plays, may be recorded by the networked gaming system and a player may be taken directly to a table, upon logging into the system, in accordance with the recorded personal gaming history of a player. Further, based on the personal gaming history of a player, some amount of money may be taken from a player's account when seating a player, such that the player is seated with said amount of money usable for game play. Also, the automated seating option may be manually selected by the user. Currently, there are approximately nineteen steps required to open the gaming application and sit at the table with cash. The AutoSeat feature allows for seating at a table using only one step: signing on.

Also, a game client application may include a selectable automated seating option with the same operations as the automated seating option described above that is incorporated into an overlay application.

The main motivators for the AutoSeat feature are (1) to assist users in getting a table of their choice in a large, dynamic, and quickly moving data set of tables or games, (2) make the seating process more convenient for user, (3) use history and stored information to overcome ambiguous situations on the way to getting seated, and (4) apply the service to a number of frontends/interfaces from which the user might be accessing the networked gaming system.

The AutoSeat feature should be either backend- or frontend-driven. The best case is a mixture with backend storing the user's preferences and the frontend executing the query through the application programming interface.

Figure 5:
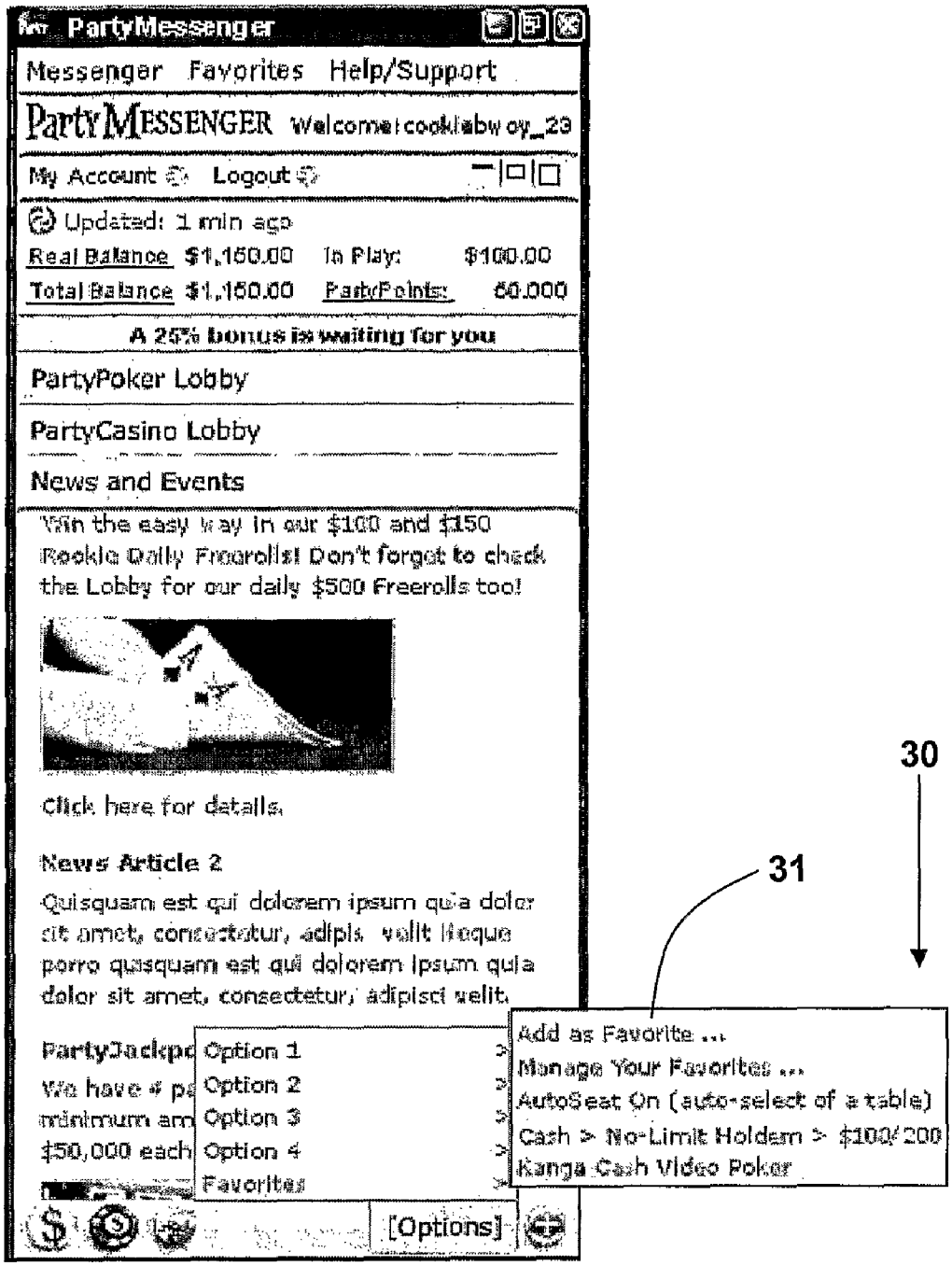
FIG. 5 is a screen shot of an embodiment of the present invention, more specifically of a messaging application that incorporates the present invention wherein the user has clicked on a Favorites option.
Figure 6:
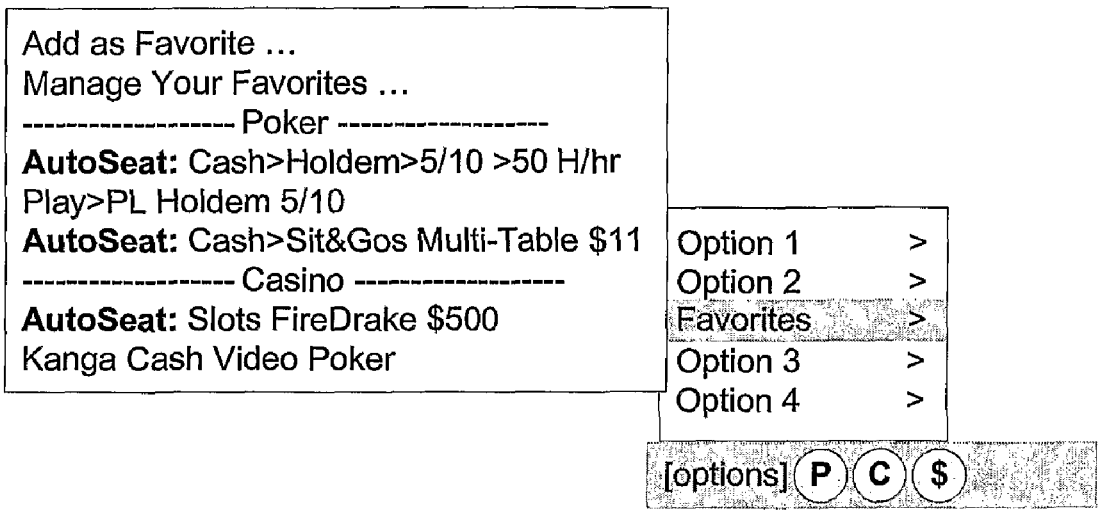
FIG. 6 is a screen shot of an embodiment of the present invention, more specifically of a messaging application that incorporates the present invention wherein the user has clicked on a Favorites option.

Referring to FIG. 5, naming conventions 30 may be used to identify the favorites. The following are examples of naming conventions and structures that may be taken for poker and casino games:

1.1. Poker Cash Games: Cash>Pot-Limit Omaha>$0.10/0.25 PL
1.2. Poker Jackpot Tables: Holdem>Bad Beat Jackpot>$15/30
1.3. Poker Tournaments: Tournaments>Regular
1.4. Poker Sit&Gos: Sit&Go's>Steps>2-Table Steps
1.5. Poker Play Money Games: Play>Pot-Limit Hold'em>50/100 PL
1.6. Casino: Cash Cruise Slots, Kanga Cash Video Poker The structure of the Favorites may be either in a one-level list, or as a multiple-level (subfolders/flyout) list. FIG. 6 shows a favorites list limited to one level and no sub-folders are included.

When opening the messaging application, the favorites are read from the existing favorites of the user, whether through clients or server to provide functionality to have seamless sharing of favorites between various brand-specific clients and the messaging program. If no favorites exist, the favorites folder may be empty.

Favorites may be added either in the messaging application directly, or they may be added in each of the brand-specific client applications, those additions being automatically updated in the messaging application. If upon attempted addition of a Favorite it is discovered that it already exists as a favorite, then the existing one may just be over-written.

In the case of adding a Favorite, especially an AutoSeat favorite, upon choosing "Add as Favorite" 31 a separate window may open up where the user may select more AutoSeat criteria. In order to ensure that the table/seat that the AutoSeat feature selects is to the user's liking, more search criteria may be selected in addition to simply selecting the game type and stakes. Some of the possible narrowing criteria may be: Game group (e.g. Cash Games, Jackpot Tables, Sit&Go, and Play for Free), Game Type (e.g. NL Holdem, Limit Holdem . . . ), Stakes (e.g. 5/10, 10/20 . . . ), Seats at Table (2, 6, 10), Players at table (e.g. Number=X, X or more, X or less), Waiting (Waitlist OK, Waitlist not OK), Hands per hour (e.g. Number=X, X or more, X or less), Average pot (e.g. Number=X, X or more, X or less), or Buy-in (Min. buy-in, Normal buy-in, Full balance).

Figure 7:
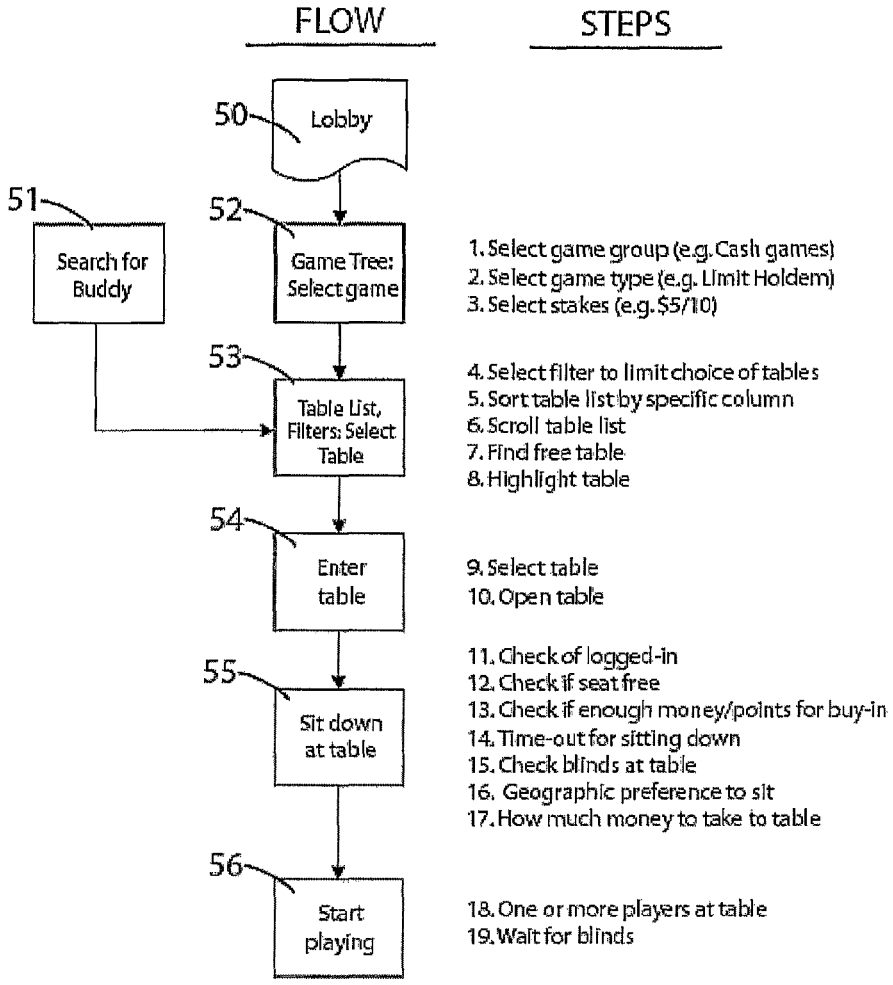
FIG. 7 is a flowchart of the approximate nineteen steps a user takes in order to play at a table.

AutoSeat favorites automatically select a game table for the user, open it up, buy-in, and sit the player down. AutoSeat is a direct favorite with additional data and procedures to directly sit down on a table and "buy-in." The logic of table selection in the AutoSeat feature may be taken and modified from the existing Waitlist functionality. FIG. 7 is a flowchart that shows an embodiment of the about nineteen steps it takes a user to sit at a game table to play. First, the user begins in a lobby 50. From there, the user selects the game group 52. The game group query is narrowed by various filters 53. Alternatively, if the user would like to play at a table with a "buddy" from a buddy list, the user may search for buddy 51. The next step is to enter the table 54. Then the user sits the player down 55 at the table. Finally, a user may begin playing 56. The approximately nineteen steps may include: 1. Select game group (e.g. Cash games), 2. Select game type (e.g. Limit Holdem), 3. Select stakes (e.g. $5/10), 4. Select filter to limit choice of tables, 5. Sort table list by specific column, 6. Scroll table list, 7. Find free table, 8. Highlight table, 9. Select table, 10. Open table, 11. Check of logged-in, 12. Check if seat free, 13. Check if enough money/points for buy-in, 14. Time-out for sitting down, 15. Check blinds at table, 16. Geographic preference to sit, 17. How much money to take to table, 18. One or more players at table, and 19. Wait for blinds. In contrast to the nineteen step process described herein and depicted in FIG. 7, the AutoSeat feature allows for seating at a table using only one step: signing on.

Figure 8:
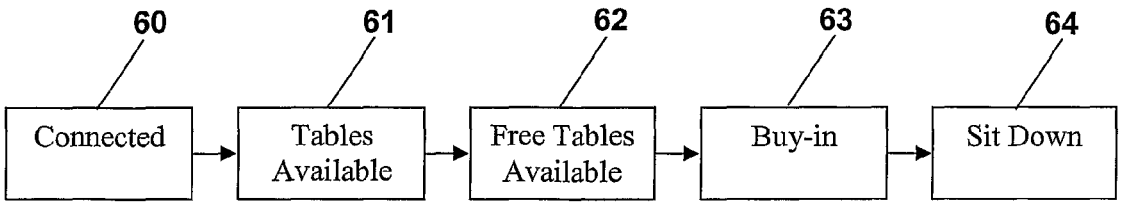
FIG. 8 is a flowchart of the typical steps the system takes in order to automatically sit a player at a table and buy-in for the player automatically.

Referring to FIG. 8, after choosing a Direct or AutoSeat Favorite, the process of seating a player follows the sequence: Connected 60-->Tables available 61-->Free tables available 62-->Buy-in 63-->Sit Down 64.

i. Connected

If the system or Internet connection 60 is down, then the standard error popup will be displayed in case a user loses connection.

ii. System Checks for Availability of Tables

If currently no tables are available 61 in the selected game type/stake combination (e.g. No-Limit Hold'em $5/10), a popup will come up telling the user "There are currently no tables available in [GAME TYPE]/[STAKE]. Please try other [GAME TYPE] tables." When clicking on the OK button, the popup closes and the user will be taken to the [GAME TYPE] category, which includes tables from all stakes. [GAME TYPE]/[STAKE] combinations are applicable for live games and Sit&Go's (which use Buy-ins).

If currently no tables are available 61 in the selected game group (e.g. Cash Games), a popup will come up telling the user "There are currently no tables available in [GAME GROUP 1]. Please try [GAME GROUP 2]." with [GAME GROUP 1] being the game group he is looking for and [GAME GROUP 2] being the other available game group (game groups are Cash and Play). When clicking on the OK button, the popup closes. The user will stay in his current lobby selection.

Refining criteria can be used to filter for a table of choice. Independent of the game type or stake, these filters may have special behaviors if no table is found with the exact criteria.

For the refiner "Average Pot Size," the criteria may be: "X or more" or "X or less." If the selected average pot restriction does not retrieve any tables, but tables with other values are available, a popup may come up saying "We did not find any tables with avg. pot [SELECTED VALUE] or [SELECTED CONDITION, LESS OR MORE]. However we found similar tables with different avg. pot values. Please repeat your search again after a few seconds, or take a look at the other tables we found." Clicking on "Try again" may trigger another lookup for the exact criteria again. "View other tables" will just open the according game types/lobby and let the user manually go through the tables.

A refiner for Sit-and-Go tournaments is the buy-in amount. If the selected buy-in value does not retrieve any tables, but tables with other values are available, a popup will come up saying, "We did not find any tables with a [BUY-IN] buy-in, however we found similar tables with different buy-ins. Please repeat your search again after a few seconds, or take a look at the other tables we found." Clicking on "Try again" may trigger another lookup for the exact criteria again. "View other tables" will just open the according game types/lobby and let the user manually go through the tables.

For the refiner "Hands per hour," the criteria may be: "Number=X," "X or more," or "X or less." If the selected hands per hour restriction does not retrieve any tables, but tables with other values are available, a popup will come up saying "We did not find any tables with avg. pot [SELECTED VALUE] or [SELECTED CONDITION, LESS OR MORE]. However we found similar tables with different hands per hour values. Please repeat your search again after a few seconds, or take a look at the other tables we found." Clicking on "Try again" will trigger another lookup for the exact criteria again. "View other tables" will just open the according game types/lobby and let the user manually go through the tables.

Similar messages to those above may pop up if other search criteria is not met, but similar tables are available. Also, if the user uses a combination of criteria for auto-seating and does not get any tables, the system may loosen the above criteria one by one in a pre-defined order and check again for availability.

iii. System Checks for Availability of Free Tables

A differentiation in handling a search for free tables 62 will be required for users which are willing to be put on a wait list and users who do not. This preference may be set when adding/changing a Favorite. The following table, Table 1, lists possible scenarios based on the assumption that the system does not find any free table based on the selections done. As mentioned above [STAKE] can be understood as stake, blinds or buy-in, depending on game type.

TABLE 1

| Use Case/Criteria | Behavior w/Waitlist on | Behavior without Waitlist |
|---|---|---|
| [GAME TYPE]/[STAKE] combination, e.g. Limit Hold'em $5/10 | If all [GAME TYPE]/[STAKE] tables are full, the system picks the table with the shortest waitlist, opens it and automatically signs the user into the waitlist (see below mockup 2). The standard behavior of the client takes over. If there are multiple tables with the same short waitlist, the first table by alphabet will be taken. | Popup comes up telling the user "Currently all [GAME TYPE]/[STAKE] tables are full. Would you like to join the waitlist at the table with the shortest waitlist?" When clicking on the "Get on Waitlist" button, the popup closes and the user will be taken to the table with the shortest waitlist and automatically included on the waitlist (see mockup 2). The standard behavior of the client takes over. When clicking on "No, check again." the query will be repeated. When clicking on "Cancel" the user will be taken back to where he was. |
| [GAME TYPE], e.g. Limit Hold'em | Same behavior as with [GAME TYPE]/[STAKE] tables. | Same behavior as with [GAME TYPE]/[STAKE] tables. |
| [GAME GROUP], e.g. Cash games | Same behavior as [GAME TYPE]/[STAKE] tables. | Same behavior as with [GAME TYPE]/[STAKE] tables. |
| Avg Pot ("X or more", "X or less"), e.g. "$20 or more" | Same behavior as with [GAME TYPE]/[STAKE] tables. | Popup comes up telling the user "Currently all tables with avg. pot [SELECTED VALUE] or [SELECTED CONDITION, LESS OR MORE] are full. Would you like to join the waitlist at the table with the shortest waitlist?". |

TABLE 1-continued

| Use Case/Criteria | Behavior w/Waitlist on | Behavior without Waitlist |
|---|---|---|
| | | When clicking on the "Get on Waitlist" button, the popup closes and the user will be taken to the table with the shortest waitlist and automatically included on the waitlist. The standard behavior of the client takes over. When clicking on "No, check again." the query will be repeated. When clicking on "Cancel" the user will be taken back to where he was. This behavior is applicable for Real and play Money. |
| Buy-in (STTs), e.g. 1-Table $11 | Same behavior as with [GAME TYPE]/[STAKE] tables. This behavior is applicable for Real and play Money. | Same behavior as with [GAME TYPE]/[STAKE] tables. Different message: "Currently all tables with a [BUY-IN] buy-in are full. Would you like to join the waitlist at the table with the shortest waitlist?" |
| H/hr ("X or more", "X or less"), e.g. "46 or more" | Same behavior as with [GAME TYPE]/[STAKE] tables. | Same behavior as with avg. pot tables. Different message: "Currently all tables with [SELECTED VALUE] or [SELECTED CONDITION, LESS OR MORE] H/hr are full. Would you like to join the waitlist at the table with the shortest waitlist?" |
| Seats (2, 6, 10), e.g. 6 table | Same behavior as with [GAME TYPE]/[STAKE] tables. | Same behavior as with avg. pot tables. Different message: "Currently all tables with [NUMBER] seats are full. Would you like to join the waitlist at the table with the shortest waitlist?" |
| Status in STTs (Registering, Level 1, Finished, . . . ) | N/A, STTs not offering Wait list | Same behavior as with avg. pot tables. Different message: "Currently no STTs with your preferences are available at the moment. Please wait 1-2 minutes and check again, if tables are available.". When clicking on "Check again." the query will be repeated. When clicking on "Cancel" the user will be taken back to where he was. |
| Players ("X or more", "X or less"), e.g. 7 players | Same behavior as with [GAME TYPE]/[STAKE] tables. | Same behavior as with avg. pot tables. Different message: "Currently all tables with [SELECTED VALUE] or [SELECTED CONDITION, LESS OR MORE] players are full. Would you like to join the waitlist at the table with the shortest waitlist?" |

For combinations of above criteria, if the user uses a combination of criteria for auto-seating and does not get any free tables, the system may loosen the above criteria one by one in a pre-determined order and check again for availability.

If a free table fitting the exact filter of a user is found, the user will be taken to the table. If more then one table fitting the exact filter of a user is found, then a random selection may be used to pick the table. After above selection criteria have been run through and a table been found, the table will be directly opened. Even if issues arise during sitting down, the table should be open to give the user more incentive to proceed towards taking a seat. An immediate check of proper login information or sufficient balance could be done when the user triggers the direct or AutoSeat Favorite, but is not chosen as it is deemed to be more important to open the table and with this give the user a graphic incentive to proceed until he sites down.

iv. Buy-In

To buy-in 63 for Direct Favorites the user will take over to sit down (i.e. buy-in manually). For the AutoSeat feature, the following seat-taking procedure will be triggered.

Step 1: Logged in? If the user is not logged in yet, he will get the login dialogue for login. After successful login the user will automatically get seated. In case the user has either Auto-Login activated and/or "Remember me," the login will be done automatically by the system, so the user does not have to.

Step 2: Play Money vs. Real Money user. If the system detects a Play Money user trying to log into a Real Money game, the standard handling is being triggered, of a popup being displayed to the user.

Figure 9:
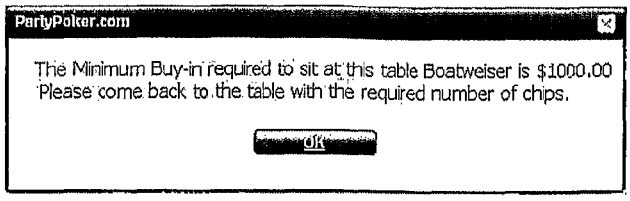
FIG. 9 is a screen shot of an insufficient funds error message.

Step 3: Buy-in. There may be three or more different buy-in criteria, including "Minimum buy-in," "Normal buy-in/Full balance," or "Fixed Buy-in/Tournament." If the user does not have enough money in his account to meet the minimum buy-in criteria, an error message will be triggered, as seen in FIG. 9.

After that popup, the buy-in window will open and the user would be required to go to the Cashier and increase his balance. In case the user selected the Minimum Buy-In option, and he has the according amount in his account, he will get seated properly, the minimum buy-in deducted from his balance and added to the table and the user may start playing.

For the "Normal buy-in/full balance" option, if the user does not have the specified buy-in amount but at least the minimum buy-in, a popup will appear with the message "You have [USER'S BALANCE] in your account. Please specify how much you want to take to the table." When clicking on OK the user may be taken to the buy-in dialogue where he may specify his buy-in. After that popup the buy-in window will open and the user would be required to go to the Cashier and increase his balance.

For the "Fixed buy-in (tournaments)" option, in the user will be seated, if he has sufficient funds in his account. In case he does not, a popup may appear: "You do not have sufficient funds in your account. Please come back with the appropriate number of chips." When clicking on OK the user will get directed to the buy-in dialogue where he can go to the cashier.

v. Sit Down

To sit down 64, the user may have selected a refiner "Players per seats" which may refine the search based on the number of seated players at a given table taken as a ratio of the total number of seats at the table. Possible criteria for this refiner are: "Ratio=X," "X or more," or "X or less."

With tournaments (especially Sit-and-Go tournaments), a concern is that even if a table is listed as available, in the time it takes a user to double-click on the table listing and buy-in, the table has already been filled because of the large number of players trying to access that type of game. This may happen multiple times in succession, and the user may become frustrated and decide to refrain from playing. The AutoSeat feature will help remedy this problem.

If the Status of a tournament has changed from Registering to any other status (e.g. Level 1, or first level of play), the system should automatically look after a new Tournament/table. To avoid the user losing his seat while the system is seating him, the seat should be reserved by the system at the point the free seat is found. Once all five of the above steps have been completed, the user will be seated and can start to play.

Manage/Remove Favorites

Figure 10:
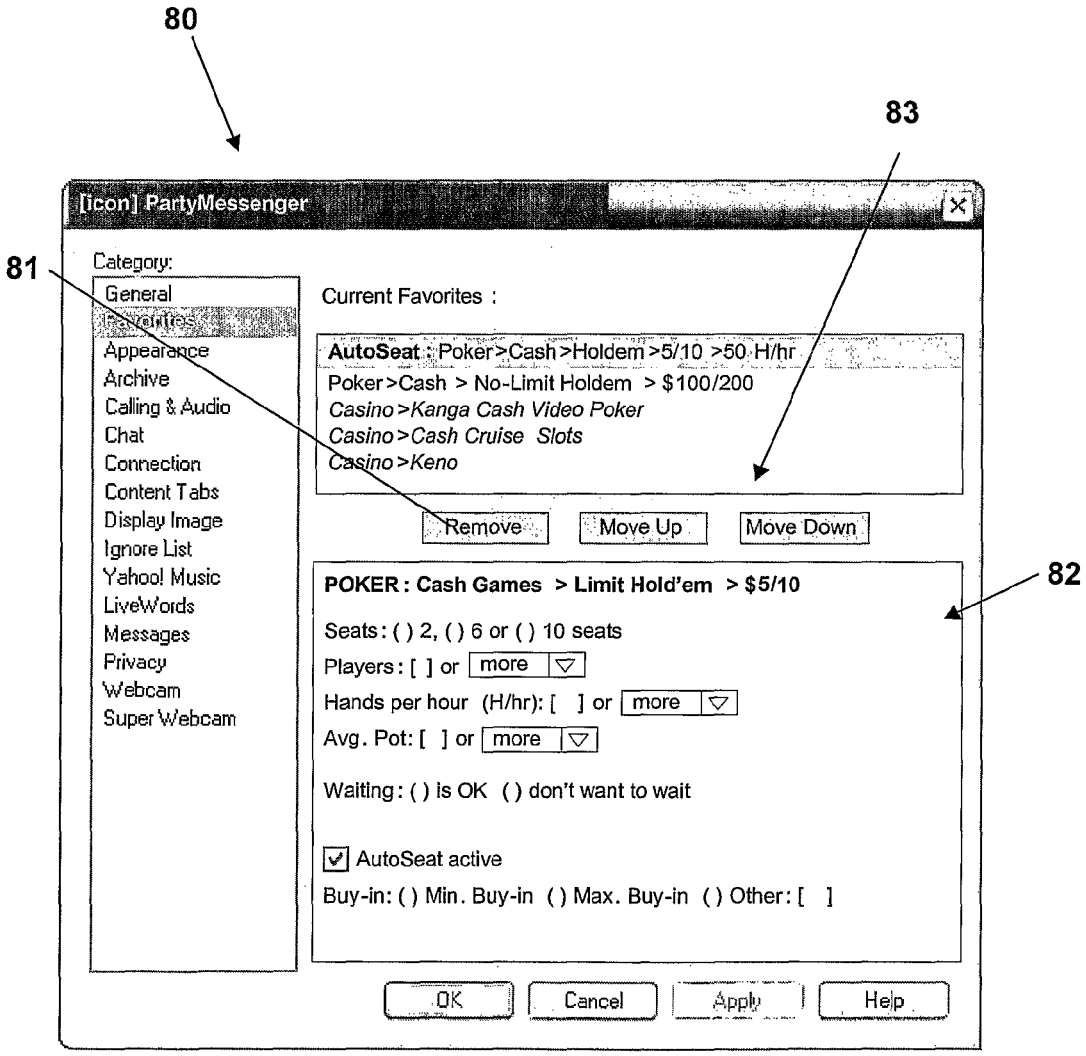
FIG. 10 is a screen shot of a Favorites Manager interface for a poker client.

Referring to FIG. 10, a user can add, change the position of, or remove a favorite in a Favorites Manager 80 interface. The feature can be accessed through the Favorites drop-down 16. When clicking on the according option a dialogue opens up that lets the user arrange his Favorites and remove them 81. The user can save and close, or discard his changes. Referring to FIG. 5, when the user clicks on "Add Favorites" 31, the current section will be added as Favorite in the messaging application. A Favorites Manager 80 may appear to allow the user to select refining search criteria in the case of Direct or AutoSeat favorites. This allows a user to change preferences 82 of each favorite, remove favorites 81, or rank favorites 83.

Figure 11:
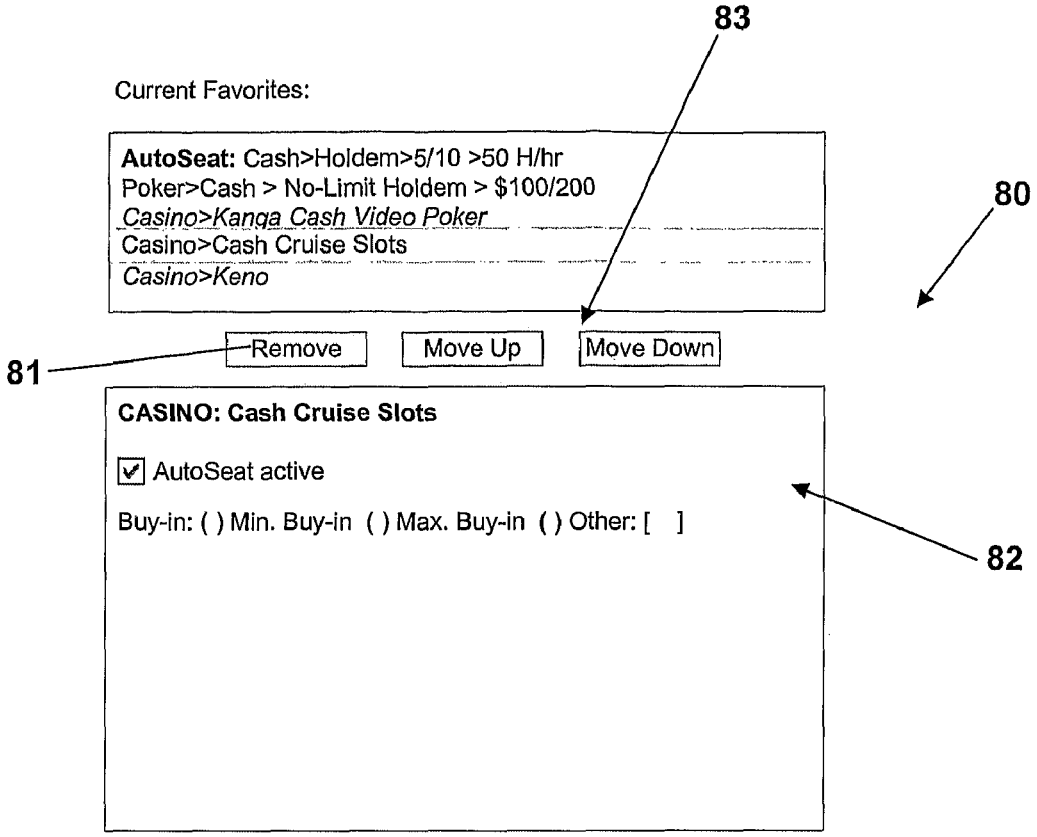
FIG. 11 is a screen shot of a Favorites Manager interface for a casino client.

FIG. 11 is an embodiment of a Favorites Manager 80 for a casino client rather than a poker client. Similar features to the poker client Favorites Manager 80 are shown, including allowing a user to change preferences 82 of each favorite, remove favorites 81, or rank favorites 83

C. Login Section

Referring to FIG. 1, below the Drop-Down Menus 12 there may be a section for logging into and managing a user's account. The Login Section 14 (or "My Account" section) will have the same behavior and style as the My Account sections in the brand-specific client applications. In case of a loss of connection, the user may be logged out and the My Account section 14 automatically reloads back to the blank login screen. If the messaging application is in active or snooze mode, this does not have any effect on the My Account section 14. One feature, Auto-login 19, will give the user the ability to automatically log into the messaging application when opening it up. This can be especially useful for heavy users which want to auto-start and auto-connect to the messaging application at computer startup. The feature can also be disabled in the settings.

D. Game Navigation/Sliders

Figure 12:
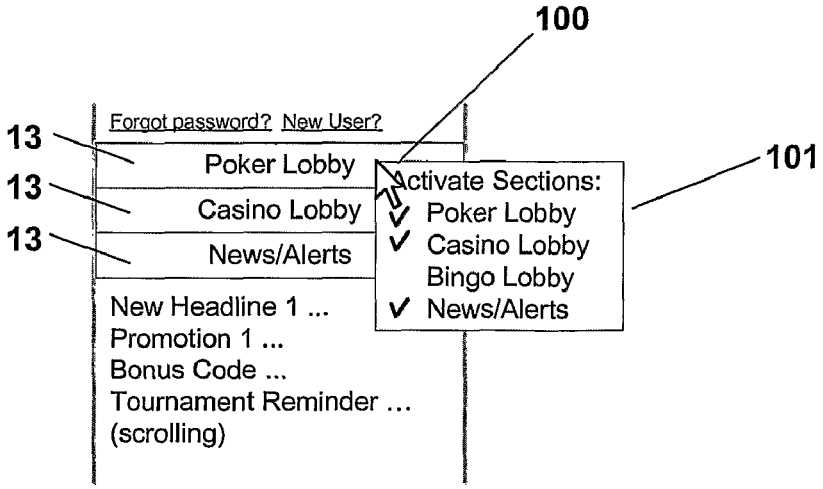
FIG. 12 a screen shot of an embodiment of the present invention, more specifically of a messaging application that incorporates the present invention, wherein the messaging application has multiple sliders that open various lobby sections of the messaging application.

Referring to FIG. 1 and FIG. 12, the various brand-specific client applications can be accessed via sliders 13 that are accessible through the messaging application. Clicking on a slider 13 will expand the section with other sections minimizing. The sliders 13 will have the same behavior as in the brand-specific client applications. Right-clicking 100 on any slider 13 may give the user a menu 101 to add and remove sliders 13 into the messaging application window.

The lobbies of the brand-specific client applications may be accessible through the sliders 13 without the user having to login. The lobbies may be accessible independent of whether the client is installed, however if a client is installed the according lobby will open per default. If a given game client application is installed, the associated game client application lobby may be opened from the overlay application (messaging application). The overlay application lobby provides the same game choices as the at least one game client application lobby.

Poker Lobby Slider

Figure 13:
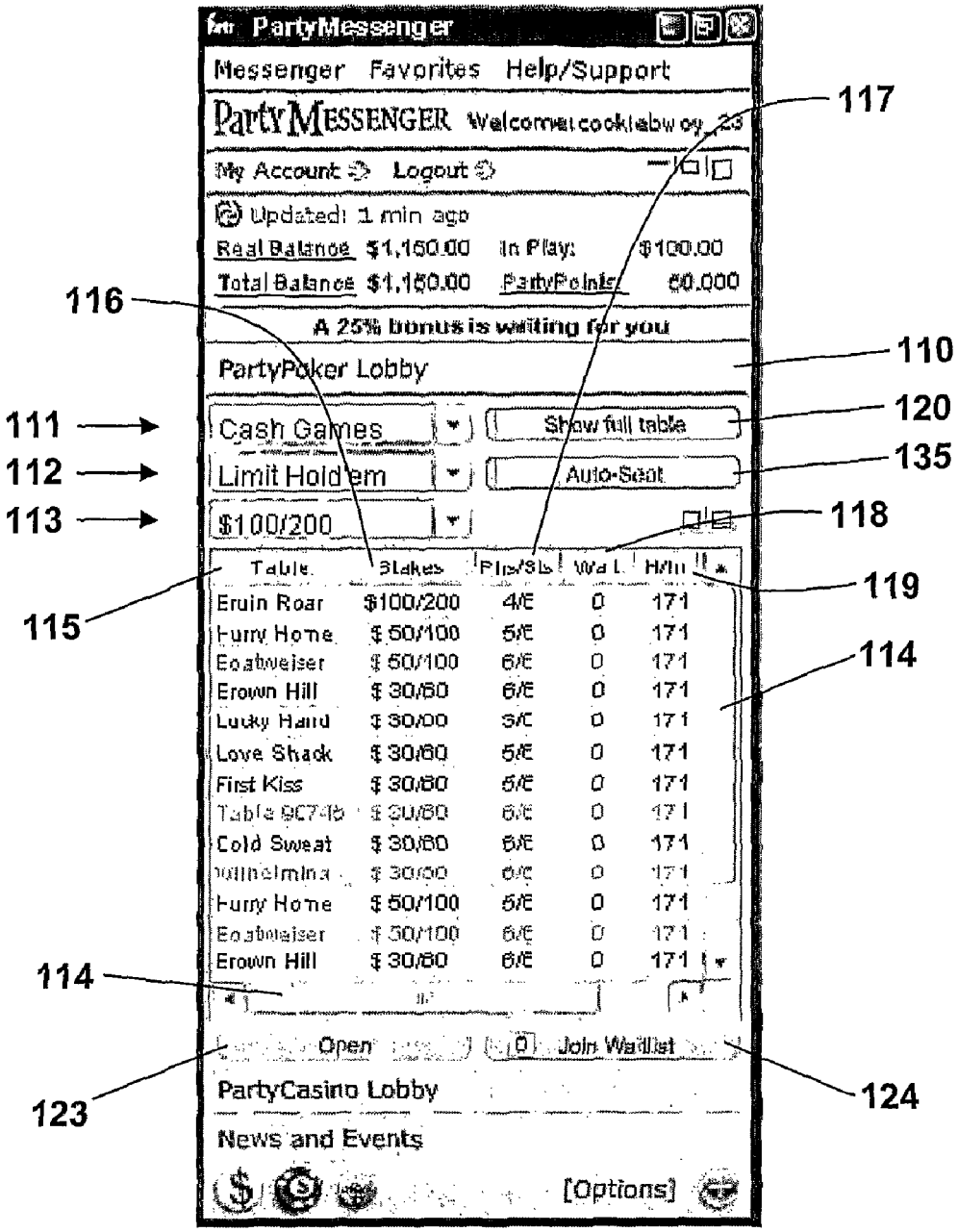
FIG. 13 is a screen shot of an embodiment of the present invention, more specifically of a messaging application that incorporates the present invention wherein the user has selected the poker lobby slider.

Referring to FIG. 13, the Poker lobby slider 110 has the same characteristics as a brand-specific client poker lobby with the difference of the dimensions. The same error case handling can be applied as well. If the messaging application is maximized and the poker lobby slider 110 is extended, the lobby will refresh. This will happen independent of whether the user is logged in/out, snoozed, or active. In any other case (maximized messaging application but poker lobby section not extended, messaging application window minimized) refresh does not take place. For easier access to the tables of choice in the limited dimensions of the messaging application, filters along the poker tree navigation levels are used. The top-level filter 111 may contain broad categories such as: Cash Games, Jackpot Tables, Sit & Go, Tournaments, Tournament Events, or Play for Free. Second level navigation items 112 match the secondary navigation in the brand-specific client poker lobby, e.g. the "Cash Games" top-level section may include Hold'em, Omaha, Stud and other games. The third level 113 may contain the stakes as a refiner, e.g. All, $5/10, $ 10/20, etc.

When changing the filters, the selection change is requested immediately; a submit command (e.g. clicking on submit button or hitting return) is not required. Order of filtering is from first to third level descending, i.e. the top-level selection influences the second level, which influences the third level, which influences any other levels there may be. If the user changes the top-level navigation 111, both second level navigation items 112 and third level 113 will change. Initial selection in the Poker lobby may be: Cash Games>Limit Hold'em>$100/$200.

Vertical and horizontal scroll bars 114 will enable the user to quickly scroll up and down the table list and also right, in case his window is not wide enough to display all columns. Default position of the list window will be top left of the list. The scroll bar 114 will have the same functionality as other standard scrollbars. In case the table list is shorter then the window, the scroll bar 114 vanishes.

To live games (not tournaments), the fields "Table" 115, "Stks" (Stakes) 116, "Plrs/Sts" (Players/Seat) 117, "Wtg" (Waiting) 118, "H/hr" (Hand/hour) 119 and "AvgPot" (Average Pot) [not shown] may be displayed in the table list. Full tables may be displayed in a different color, preferably grey. There may be a full table filter 120: a button will let the user hide or show full tables. By default the button may be pressed and say "Show full tables." In this case, full tables are being hidden. If the user depresses the button, it will say "Hide full tables." Full tables are now being shown. In general, all of the same filters as available in the main client should also be possible in the messenger.

If there are no results available in the table list, the table list will be empty, just showing one entry messaging "No tables available. Use the filters to find other games or check back at a later point." If tables exist, but are not being shown due to an active full table filter, the full table filter button 120 deactivates and the tables will be shown, even if full. The button setting is remembered and as soon as the user changes the selection, the button jumps back to its settings. All fields/columns can sort the table list the same way as currently a poker client lobby does. Sorting will be ascending/descending fashion, following the same behavior a poker client lobby has.

Figure 14:
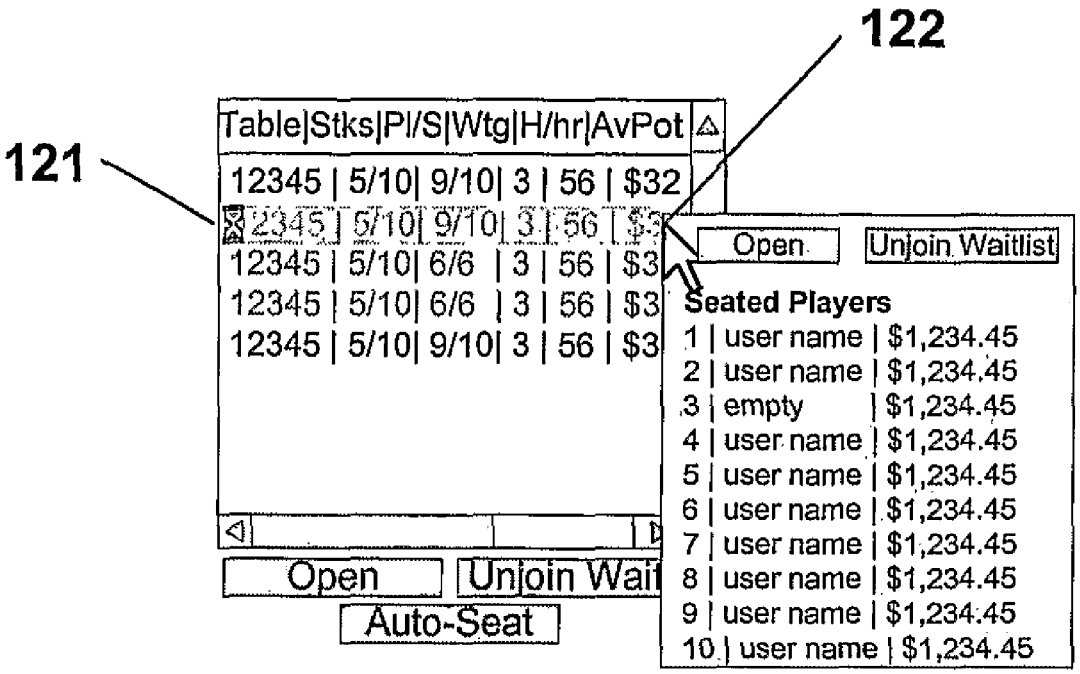
FIG. 14 is a screen shot of an embodiment of the present invention, more specifically of a messaging application that incorporates the present invention wherein the user has selected a specific table.

Referring to FIG. 14, by left-clicking 122 on a table 121, the table will be highlighted. Double-clicking on a table, it will open. You can also open through the "open" button 123 below the table list, as seen in FIG. 13. An "Open" button 123 lets users enter a game after highlighting it. If a user highlighted a table, which he is already sitting at, the "Open" button 123 will de-activate. The "Waitlist" button 124 lets the user join a waitlist for a table. As in the some poker lobbies, the Waitlist button 124 will show the number of people waiting already. In this example, that number is zero ("0").

Figure 15:
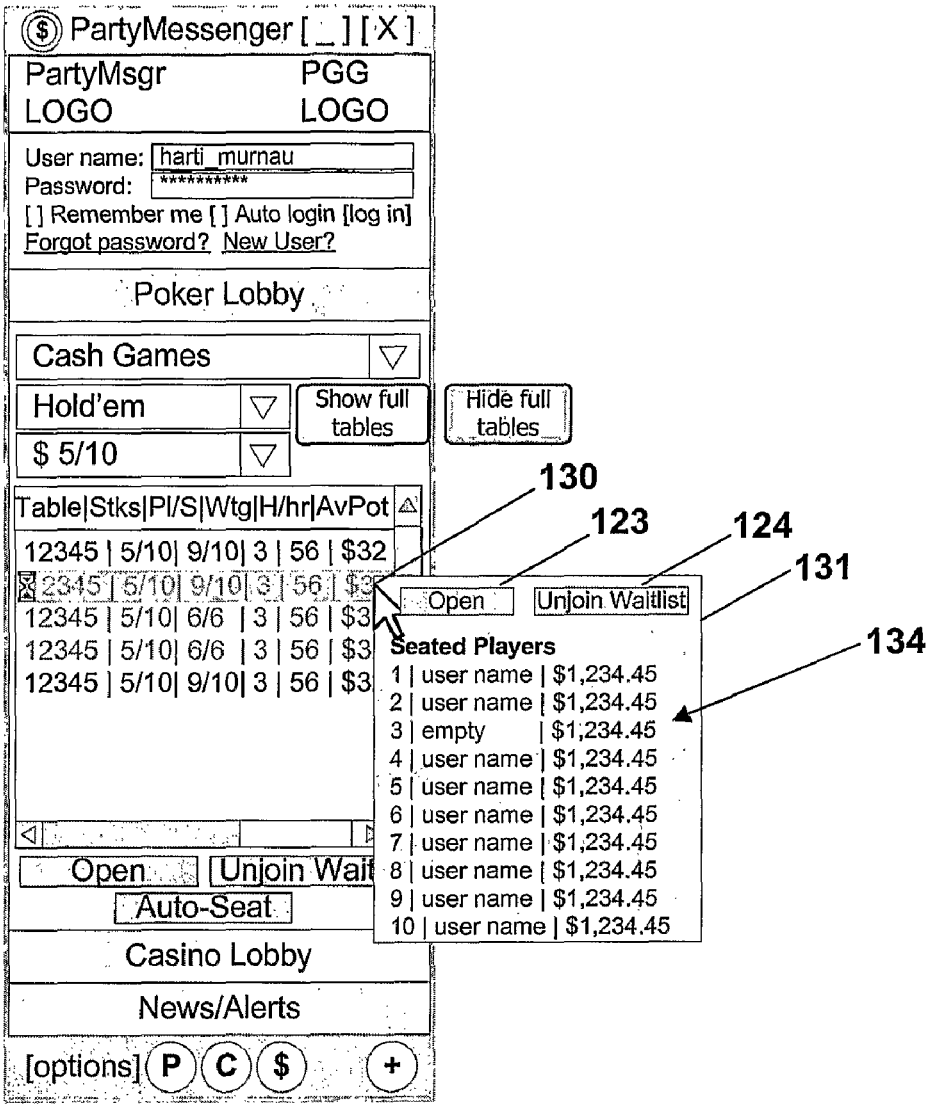
FIG. 15 is a screen shot of an embodiment of the present invention, more specifically of a messaging application that incorporates the present invention wherein the user has selected a specific table.

Referring to FIG. 15, right mouse-clicking 130 on a table will bring up a context menu 131 where the user can may see an open button 123, a join/unjoin a waitlist button 124, and may see information 134 about players at the table.

The rules defined for the Open button 123 and Waitlist button 124 apply to the buttons in the menu as well. Clicking on the "Open" button 123 the user will enter the table. In case he is already on the table (means, the table is open), playing or not, the table will become active, i.e. jumping in the front of the monitor. Clicking on the "Waitlist" button 124 the user will enter the table's waitlist. In case he is already on the waitlist, the button will be inactive and a small icon will be messaging the fact and he will have the option to unjoin. Referring to FIG. 13, the Auto-Seat button 135 will save the user from manual selecting and immediately sit him on a free table. The Auto-Seat feature will follow the selection process of the Waitlist option.

Navigation, selection, and access to the table happens in the messaging application lobby. From there the table picks up the process. This implies the fact that a poker table does not need a poker client open to play. After the user double-clicked or opened a table, the table opens up so the user can watch the table. If the user wants to take a seat, buy-in, and any other features are being taken over by the existing table functionality. As is the present case, at this point the blocked country list will be enforced.

Tournaments

Figure 16:
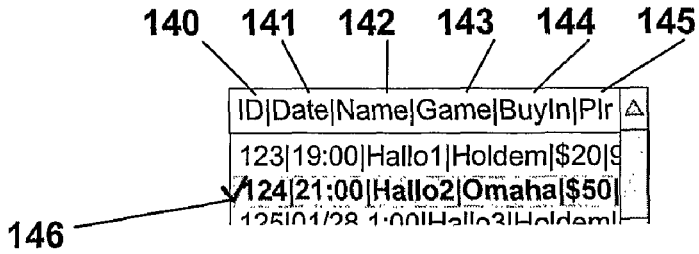
FIG. 16 is a screen shot of an embodiment of the present invention, more specifically of a messaging application that incorporates the present invention wherein the user is registered for a tournament.

Referring to FIG. 16, for tournament poker tables, the fields "ID" 140, "Date" 141, "Name" 142, "Game" 143, "Buy-In" 144, and "Plr" (Player) 145 will be displayed in the table list. Tournaments which are not accessible anymore to the user may display in grey color. A tournament may also be listed with a grey color if it is either a full tournament or a tournament that has already started and does not offer a late buy-in. Tournaments for which the user has already registered 146 for will be displayed in bold and feature an icon messaging confirmation and registration Tournament filter buttons may allow let the user to hide or show specific tables.

Also, the user may have the option of setting "Announced," "Registering," or "Your Tourneys" filters. In line with the client lobby functionality, these buttons will filter for tourneys which are announced or registering. To save display area, running and finished tournaments will not be shown. In addition the filter "Your Tourney" will be showing only the tournaments the player is currently registered for or playing in.

All fields in the table list can sort the table the same way as currently a poker client lobby does. Sorting will be ascending/descending fashion, but following the same behavior a poker client lobby has.

Figure 17:
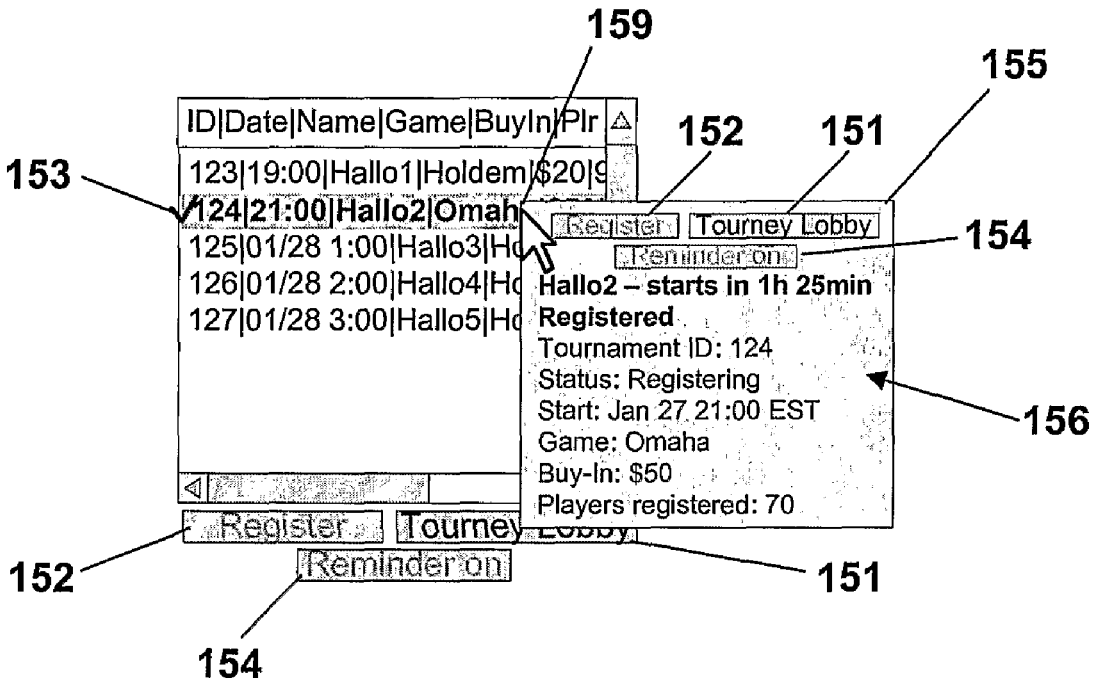
FIG. 17 is a screen shot of an embodiment of the present invention, more specifically of a messaging application that incorporates the present invention wherein the user is registered for a tournament.

Referring to FIG. 17, by clicking on a tournament once the selection will be highlighted. Double-clicking on a tournament will bring the user to the tournament lobby. The existing tournament lobby will open in a new window. All functions of the lobby should be as they are now in the client application. You can also access the lobby through the "Tourney Lobby" button 151 below the table list. In case a user is already on the table (means, the table is open), playing or not, the table will become active, i.e. jumping in the front of the monitor.

A "Register" button 152 lets the users register for a tournament after highlighting it. If a user highlighted a tourney, which he is already registered for, the "Register" button 152 will de-activate and a small icon checkmark icon 153 will be messaging the fact in the table list.

Registration will happen after the same process as currently. There may be a "Reminder" button 154, which triggers the Tournament Reminder feature. The Tournament Reminder is a built-in alert count-down, which does not need any online connection. To anticipate scheduled changes however it monitors the tournament it is attached to and changes reminder times and alerts, if the tournament start time changes. This feature may be used in pre-login stage. Only when reserving or going to the tournament lobby the user will be required to log in.

Right mouse-clicking 159 on a tournament will bring up a context menu 155 where the user whether can Register 152, enter the Tourney Lobby 151 or will see tournament details 156. The rules defined for the Register button 152 and Tourney Lobby 151 buttons apply to the buttons in the menu as well.

Navigation, selection, and access to the tournament lobby happens in the messenger application lobby. From there the tournament lobby picks up. If the user wants to register, watch a table, take a seat, get more info and any other features are being taken over by the existing tourney lobby functionality. This implies the fact, that a poker table does not need a Poker client open to play. As is currently the case, at this point the blocked country list will be enforced.

Casino Lobby Slider

Figure 18:
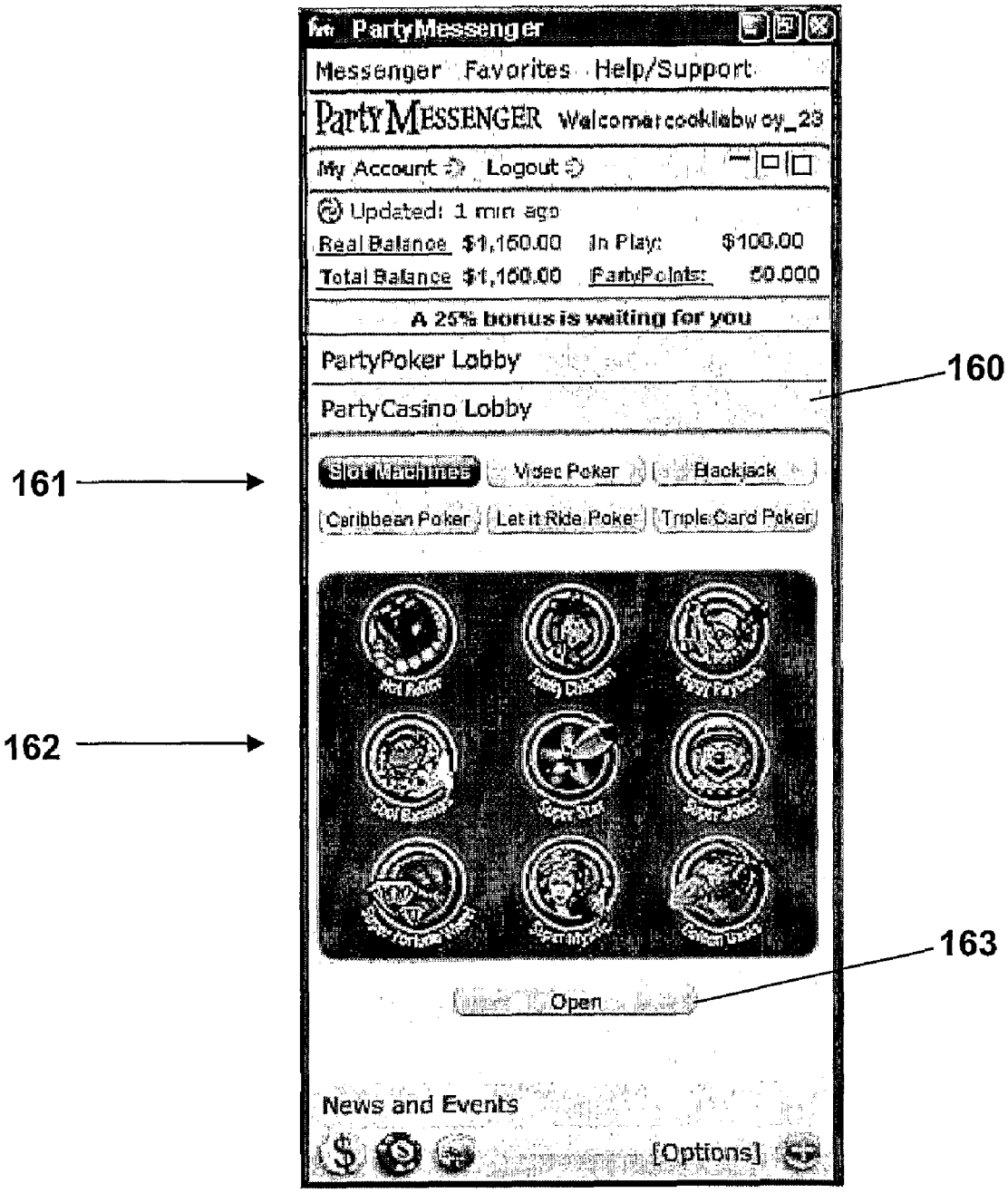
FIG. 18 is a screen shot of an embodiment of the present invention, more specifically of a messaging application that incorporates the present invention wherein the user has selected the casino lobby slider.

Referring to FIG. 18, the Casino lobby slider 160 is accessible without the user having to login. For easier access to the games of choice in the limited dimensions of the messenger application, filters along the current casino navigation are used. The top-level navigation 161 may contain such general categories of games as: Slots, Roulette, Video Poker, Blackjack, Caribbean Stud, Let It Ride, etc. The second level navigation 162 may contain the actual games, e.g. Sweet Hawaii, Cash Cruise, Super Fortune Wheel, etc. When changing the filters, the selection change is requested immediately; a submit button is not required. The Default filter values are always the first selection in case the user never changed the selection before. If the user changed a selection before, the default value will be the previous selection, when the user comes back to that drop-down.

If the user gets disconnected, navigating the lobby will be unaffected. If he tries to access a game, a popup will appear "We are sorry, but cannot open the table as the Messenger currently is not connected." When clicking on OK, the user will get back to the lobby. If disconnected, the messaging application will keep trying in the background every 30 seconds to connect again.

If more games are in a category than space allowed in the lobby, a vertical scroll bar will enable the user to quickly scroll up and down the lobby. The scroll bar will have the same functionality as other standard scrollbars. In case the table list is shorter then the window, the scroll bar deactivates.

Clicking once on a game makes that table highlighted. Double-clicking on a game will open it. While this may not be consistent with the client casino application, this is done to be consistent with the navigation behavior in the poker lobby of the messenger. You can also open through the "open" button 163 below the table list.

Right mouse-clicking on a game will bring up a context menu where the user may open the game and will see the info on the game. Info on the game will be the same as in the Casino Lobby of the client. Clicking on the "Open" button 163 the user will enter the game. In case he is already on the game, another instance of the game will open.

Navigation, selection, and access to the games happens in the messenger application lobby. From there the game functionality picks up. If the user wants to buy-in, play, or use any other features are being taken over by the existing game window functionality. This implies the fact, that casino games do not need a Casino client open to play.

Other Lobby Sliders

Other lobbies as would be obvious to persons having ordinary skill in the art may also be accessed through the messenger application. For example, a Backgammon lobby slider, a racing lobby slider, or a skill game (chess, checkers, etc.) lobby slider. Referring to FIG. 12, the sliders may me managed by right-clicking 100 on any slider and choosing the sliders that the user would like visible.

E. Footer/QuickLaunch

Referring to FIG. 1, at the bottom of the messenger application, there may be a QuickLaunch bar 10 that will behave similar to a QuickLaunch bar 10 in the client application. The QuickLaunch bar 10 may contain an icon 165 for each installed vertical client, a "Get More" selection 18, and a cashier button 164. If more icons are included than the width of the unit can accommodate, a new line may be opened. If the user clicks on the Cashier button 164, he will directly go to the cashier portion of the client application. Icons are automatically placed into the messenger QuickLaunch bar 10 when a new client is installed or offered by the brand-specific client applications. This enables the user to install, open or switch between clients.

Not installed icons may be greyed out. Installed icons 165 may be colored. If the user clicks on an icon 165, which is not installed yet, he will get a dialogue asking him "Do you want to download and install the "X" client?" Two buttons "Yes" and "No" let him proceed or cancel. If the user clicks on an icon 165 of a client which is not started yet but is installed, then the client opens. If the client is already open, it just jumps to the foreground. If the user is already signed in on one client, the other clients (if started or not) automatically sign in as well.

Figure 19:
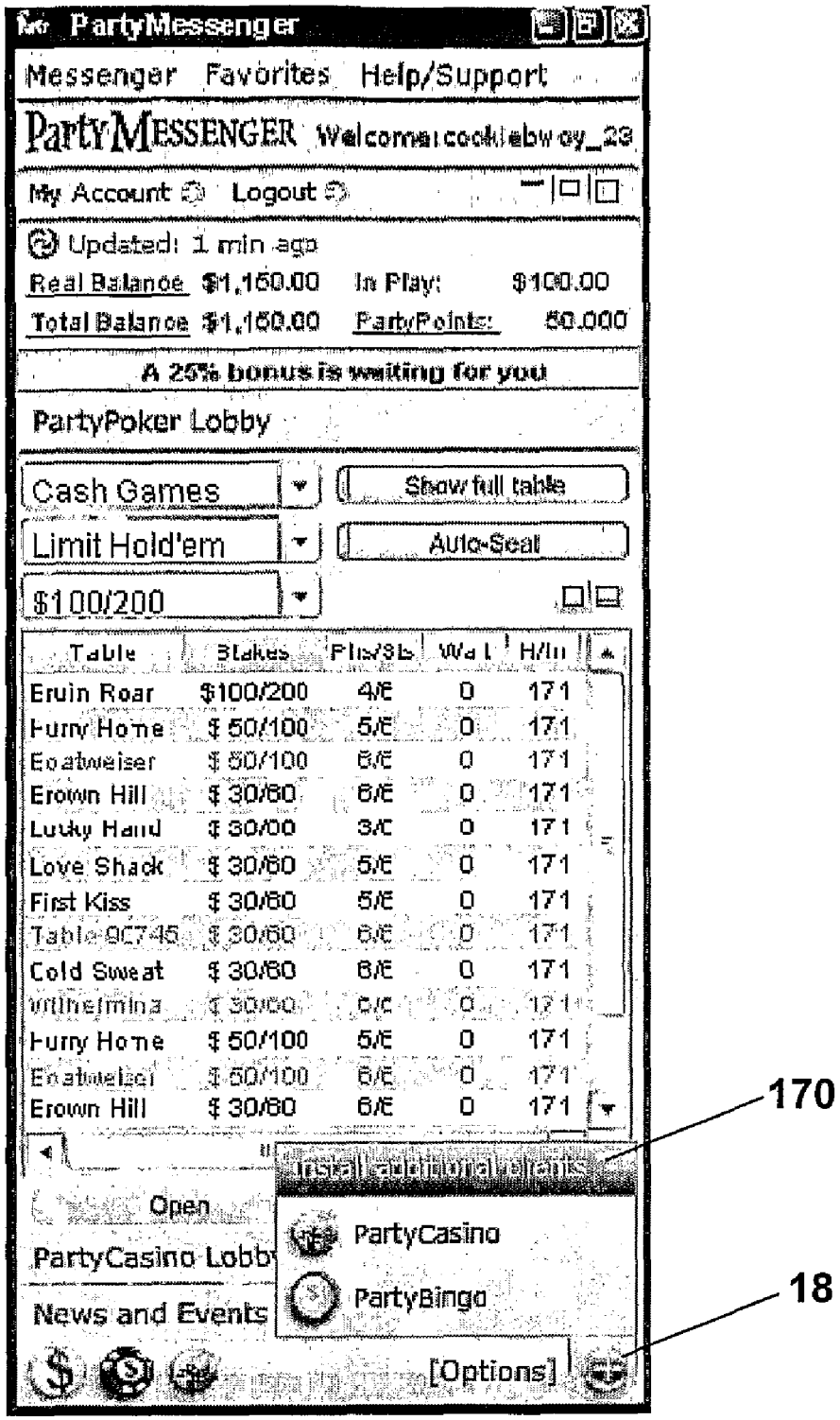
FIG. 19 is a screen shot of an embodiment of the present invention, more specifically of a messaging application that incorporates the present invention wherein the user has selected to install additional brand-specific client applications.

Referring to FIG. 19, the "Get More" selection 18 triggers a menu 170 of other games currently offered by the brand-specific client but not installed yet. If new vertical clients become available, the menu 170 automatically updates and the "Get More" selection 18 changes color in the footer and blinks. When selecting one of the vertical clients, the user goes to the vertical's website for a standard installation process (configurable, if the user could directly trigger a download/installer).

4. Messaging

A. News and Events

Referring to FIG. 1, the News & Events slider 180 may have the same behavior as currently on a client. This includes scrolling, base HTML, and maximum number of messages. This number can be changed independent of the main clients. As the messenger application dimensions can be horizontally and vertically increased in size, the base HTML format and style and the scrolling rules have to be reworked to accompany for this. The messenger application will combine messages from specific brands (Poker, Casino, Backgammon, etc.) and also from independent sources.

News, which may be in the form of scrolling text or popup items, needs to get fed to the messenger application in real-time, i.e. whenever a message to one or many users is being scheduled and then pushed by the client to the game servers, it needs to be pushed (or pulled by the application itself) to the messenger. The inclusion process of a message into the messenger application is important for the success of users receiving messages from the clients.

B. Client Messaging Tool

Information may be sent between the overlay application and the game server. This information may be a promotional message from the game server to users of the overlay application. A new channel will be added into a Client Messaging Tool (PAM tool) to enable a marketing department to address the client applications only, messenger application only, or both. A user will be shown messages pertaining to the messenger application itself and pertaining to clients the user has installed. For example, if a user has Poker and Casino installed, he will see all messages scheduled to Poker users and all scheduled to Casino users. As some messages are scheduled on two or more clients, the PAM tool needs to remove redundant messages so that users do not see the same twice. This can be caught due to the PAM tool enabling marketing to schedule one message to all verticals at the same time, but also needs to be handled in case messages are being scheduled separately, which can be done through the introduction of a pattern matching in the Messenger.

Prioritizing messages in the messenger will be done based on the existing prioritization scheme developed in the PAM, which will be applied to all brands in case of a user having multiple clients installed. This means, that in case of two Poker and Casino messages being scheduled in the same priority level, they will be listed with the message higher who was scheduled later.

Figure 20:
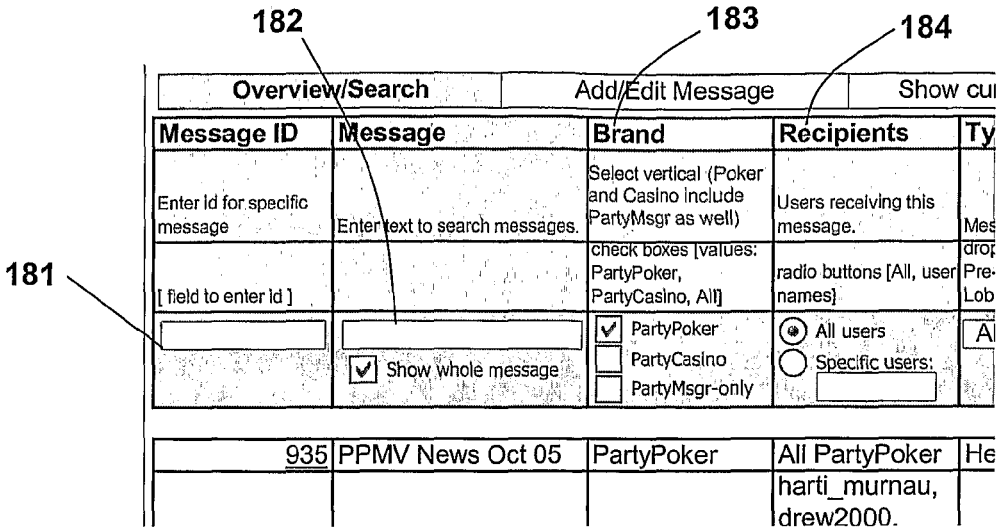
FIG. 20 is a screen shot of an automated messaging system wherein an administrator is capable to creating messages that are sent to users of various client applications.

Changes in the PAM to Search, Current Messages and Add/Edit interface are to be done in the PAM tool. Referring to FIG. 20, a PAM tool is shown. A message ID field 181 allows the PAM tool user to select a predefined message to send to the clients. A message filed 182 allows the PAM tool user to create their own new message. A brand column 183 allows the PAM tool user to select which client applications will receive the message. A recipients field 184 may allow the PAM tool user to change which clients get the message. Other fields may be apparent to those having ordinary skill in the art.

Selecting any brand in the brand column 183 will add a message to the client AND the messenger. The messenger will receive the message, if the user has the according client installed, the user has the according section enabled as slider in his Messenger (see above for including/excluding sections in the messenger). For example, if the user does not have Poker client installed, but has the Poker Lobby slider in his Messenger. All messages scheduled to Poker will also be included in the Messenger.

C. Desktop Alerts

Figure 21:
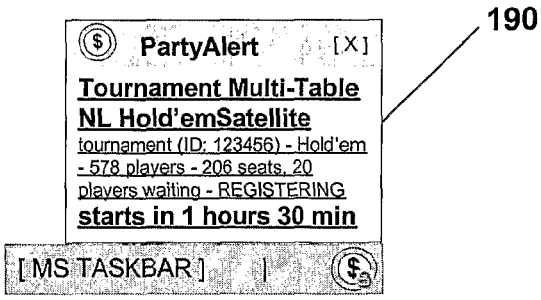
FIG. 21 is a screen shot of a desktop alert.

Referring to FIG. 21, a desktop alert 190 is a real-time alert on the user's desktop triggered by the messenger. Messages will be delivered real-time to the user, which will extend the scope from scheduled messages to transactional driven actions. To reach that, a push model will be used, i.e. whenever there is a message for the user available, it will be pushed by the system to the clients. Most messages can be delivered to the user's desktop. These messages can be triggered by the PAM tool (see above) or other delivery mechanisms. Some examples are: Bonus offers, Money added to user's account, News and Promotions, Reminders, Transactional Messages (password changed, Player's Club signup, etc.), Promotional Message (promotions, etc.), or others.

The following table, Table 2, lists some of the possible message types, where the message is originated from, and a short description of the message.

TABLE 2

| Message Type | Backend System | Description |
|---|---|---|
| News & Events | PAM | Message Composition: as scheduled<br>Priority: Prio 1 messages are highest, others lower |
| Bonus Offers | Existing bonus system | Message Composition: use same message composition as on the main client. Current message is "You have a 25% Bonus! Claim it now!"<br>Use same inclusion process as done on the client.<br>Needs to be real-time however.<br>Priority: highest |
| Money added to user's account | User Reports | Message Composition: "Congrats! You have been added $ [AMOUNT] to your account."<br>Use same inclusion process as done on the client.<br>Needs to be real-time however.<br>Priority: highest |
| Tournament Reminders | PartyMessenger (local) | Message Composition: "Congrats! You have been added $ [AMOUNT] to your account."<br>Use same inclusion process as done on the client.<br>Needs to be real-time however.<br>Priority: highest |

Messages pushed may adhere to above described prioritization system to handle any possible unanticipated message conflicts. Access controls will exist on system side to define the types of messages which will go out to the user's desktop (see separate PAM spec).

D. Message Delivery

A message may be delivered to the desktop, either (a) in real-time, i.e. while the messenger is online and active, (b) at start of the messenger, if messages have been scheduled for the user while he was offline, (c) at login to the messenger, if personal messages have been scheduled for the user while he was not logged in (during this period only anonymous messages could be sent to him), or (d) after snoozing timed out or was manually disabled by the user.

The messages may appear just above the messenger icon in the system tray aligned to the bottom right of the desktop. If other applications use the same space for messages, it still will be taken, even if there is a small likelihood of two messages popping up at the same time from two different applications. A short alert sound may be triggered when an Alert pops up.

The user can click on the message anytime when viewable on the monitor, i.e. when fully displayed or already fading out. When the user clicks on the message, the full message at the linked destination pops up. This could be a new browser window opening the specific message in the Message Center in his My Account on partyaccount.com, a news or promotion page on partypoker.com or any other website, in case of a Bonus Offer, the Party wallet window triggered from the PMsgr or the same information on partyaccount.com, or in case of Money added to your account, the PMsgr getting to the front of the monitor and the My Account section expanding. Further functionality will be handled by the triggered pages or messages.

E. User-to-User Messaging and Buddy List

Further, the information sent between an overlay application and the game server may be in the form of a chat or instant-message between two or more users of the overlay application. The messaging application may be configured in such a way as to allow users to create and manage personalized buddy lists of other users or friends. This may be similar to well-known instant messaging software available (i.e AOL Instant Messenger, Yahoo! Messenger). Users will be able to select a user from their buddy list, or a user not in their buddy list, and send a unique personal message to the other user. A user may organize his buddy list using categories such as "Friends," "Fish" (users who are not skilled in the game of poker), "Good Players," etc.

Users may also be able to set personal alerts. For example, a user may set an alert that notifies the user visually, or with a sound, that a specific other user has logged onto the networked gaming system.

A user may be able to see which games another user is playing by selecting that other user in his buddy list. Further, a user may invite another user in his buddy list to join him at a specific game. These and other features and benefits of an instant messaging program may be incorporated as would be obvious to persons having ordinary skill in the art.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

The invention claimed is:

1. A networked gaming system wherein a game client application connects a player to a server, said networked gaming system comprising:

at least one game server;

at least one game table hosted on said game server;

said game server providing game operations and displays for transmission to said game client application;

said displays including at least one lobby screen display from which a player can request to be seated at one or more of a plurality of virtual game positions in at least one of a multi-player game and a single-player game; and an overlay application, said game server providing game operations and displays for transmission to said overlay application; said displays including at least one lobby screen display accessible by the overlay application without a login to the overlay application.

2. A networked gaming system according to claim 1, wherein the overlay application is distinct from the game client application.

3. A networked gaming system according to claim 1, wherein at least one game client application lobby is associated with each of a plurality of game client applications, and wherein if a given game client application is installed, the associated game client application lobby is opened from the overlay application.

4. A networked gaming system according to claim 3, wherein a player plays a game by selecting the game from an overlay application lobby, wherein said overlay application lobby provides the same game choices as the at least one game client application lobby.

5. A networked gaming system according to claim 1, wherein when any two of said game client applications are designated as client X and client Y, when at least one of said client X and client Y is installed at least one corresponding lobby X and lobby Y opens from the overlay application, when both clients X and Y are installed, a lobby which was last open when the application was running the last time is opened from the overlay application, and when no client is installed, a predetermined lobby is opened from the overlay application.

6. A networked gaming system according to claim 5, wherein when no client is installed, the predetermined lobby is at least one of a news lobby and an events lobby.

7. A networked gaming system according to claim 3, wherein one of said game client applications and associated game client application lobbies is designated as a poker client and lobby, wherein the overlay application includes a poker lobby; wherein the poker lobby of the overlay application has substantially the same characteristics as the poker lobby of the client application with a different appearance, and wherein if the overlay application is maximized and the poker lobby is extended, the poker lobby of the overlay application will refresh independently of a player being logged in or not, snoozed or active, with respect to the game client application.

8. A networked gaming system according to claim 4, wherein the overlay application lobby has the same refresh rate as the client application lobby and is capable of at least one of sending information to the game server and receiving information from the game server.

9. A networked gaming system according to claim 1, wherein the overlay application is a messaging application.

10. A networked gaming system according to claim 1, wherein the overlay application is incorporated into a networked video game console.

11. A networked gaming system wherein a game client application connects a player to a server, said networked gaming system comprising:

at least one game server;

at least one game table hosted on said game server;

said game server providing game operations and displays for transmission to said game client application;

said displays including at least one lobby screen display from which a player can request to be seated at one or more of a plurality of virtual game positions in at least one of a plurality of multi-player games and a single-player game; and said at least one lobby screen display is accessible by the game client application without a login to the game client application.

12. A networked gaming system according to claim 11, wherein at least one game client application is installed on a computer, each game client application lobby, and any games therein, are opened from each of the at least one game client applications.

13. A networked gaming system according to claim 11, wherein when any two of said game client applications are designated as client X and client Y, when at least one of client X and client Y is installed, a corresponding at least one lobby X and lobby Y is opened from the game client application, when both clients X and Y are installed, a lobby which was last open when the application was running the last time is opened from the game client application, and when no client is installed, a predetermined lobby is opened from the game client application.

14. A networked gaming system according to claim 12, wherein each game client application lobby has the same refresh rate as the associated game client application.

15. A networked gaming system according to claim 1, wherein said overlay application includes a selectable automated seating option for automatically seating a player at one or more of a plurality of virtual game positions, wherein a player is directly seated when the player logs-in to the networked gaming system.

16. A networked gaming system according to claim 15, wherein said automated seating option of said overlay application is capable of receiving and storing personal preference information, including at least one of a game category, a specific game type, stakes, and an amount of money to be taken from a player's account when seating a player, and for seating a player at a table in accordance with said stored personal preference information.

17. A networked gaming system according to claim 15, wherein said automated seating option of said overlay application is capable of receiving and storing personal preference information, including at least one of a game category, a specific game type, and stakes, and for taking a player to a game in accordance with said stored personal preference information, wherein a player may manually select an amount of money to take to the game from a player's account.

18. A networked gaming system according to claim 15, wherein said automated seating option of said overlay application is further selectable by the networked gaming system, whereby personal gaming history, including at least one of a game category, a specific game type, stakes, and an amount of money that a player commonly plays, is recorded by the networked gaming system and a player is taken directly to a table in accordance with the recorded personal gaming history of a player.

19. A networked gaming system according to claim 18, wherein based on the personal gaming history of a player, some amount of money is taken from a player's account when seating a player, such that the player is seated with said amount of money usable for game play.

20. A networked gaming system wherein a game client application connects a player to a server, said networked gaming system comprising:

at least one game server;

at least one game table hosted on said game server;

said game server providing game operations and displays for transmission to said game client application;

said displays including at least one screen display designating a lobby from which a player can request to be seated at one or more of a plurality of virtual game positions in at least one of a plurality of multi-player games and a single-player game;

said game client application including a selectable automated seating option, wherein a player is directly seated when the player logs-in to the networked gaming system.

* * * * *